US009422660B2

(12) United States Patent
Favaro et al.

(10) Patent No.: US 9,422,660 B2
(45) Date of Patent: Aug. 23, 2016

(54) LAUNDRY WASHING MACHINE

(71) Applicant: Electrolux Home Products Corporation N.V., Brussels (BE)

(72) Inventors: Daniele Favaro, Porcia (IT); Maurizio Del Pos, Pordenone (IT)

(73) Assignee: Electrolux Home Products Corporation N.V., Brussels (BE)

( * ) Notice: Subject to any disclaimer, the term of this patent is extended or adjusted under 35 U.S.C. 154(b) by 43 days.

(21) Appl. No.: 14/410,938

(22) PCT Filed: Jun. 27, 2013

(86) PCT No.: PCT/EP2013/063556

§ 371 (c)(1),
(2) Date: Dec. 23, 2014

(87) PCT Pub. No.: WO2014/001472

PCT Pub. Date: Jan. 3, 2014

(65) Prior Publication Data

US 2015/0204005 A1 Jul. 23, 2015

(30) Foreign Application Priority Data

Jun. 29, 2012 (EP) ..... 12174327

(51) Int. Cl.
*D06F 39/00* (2006.01)
*D06F 39/08* (2006.01)

(52) U.S. Cl.
CPC ..... *D06F 39/088* (2013.01); *D06F 39/007* (2013.01); *D06F 39/02* (2013.01); *D06F 39/028* (2013.01); *D06F 39/12* (2013.01)

(58) Field of Classification Search
CPC .. D06F 39/007; D06F 39/028; D06F 39/088; A47L 15/4229; A47L 15/4231
See application file for complete search history.

(56) References Cited

U.S. PATENT DOCUMENTS 3,087,504 A * 4/1963 Geschka ..... A47L 15/4229 134/111
3,636,735 A * 1/1972 Borochaner ..... A47L 15/4229 68/12.18

(Continued)

FOREIGN PATENT DOCUMENTS

EP 0437713 A2 7/1991
EP 1085118 A2 3/2001

OTHER PUBLICATIONS

International Search Report mailed Aug. 30, 2013 in corresponding International Application No. PCT/EP2013/063556.

*Primary Examiner* — David Cormier
(74) *Attorney, Agent, or Firm* — Banner & Witcoff, Ltd.

(57) ABSTRACT

Laundry washing machine (1) includes an outer casing (2) and, inside said outer casing (2), a washing tub (3) which is arranged inside the casing (2) with its opening or mouth directly facing a laundry loading/unloading opening which is realized in the front wall (2*a*) of the casing (2) substantially astride of the vertical center-plane (M) of the casing (2). A rotatable drum is arranged in axially rotating manner inside the washing tub (3) and is structured for receiving the laundry to be washed. A detergent dispensing assembly (9) is structured for supplying detergent into the washing tub (3). A main fresh-water supply circuit (10) is structured for selectively channeling a flow of fresh water from the water mains towards the detergent dispensing assembly (9) and/or the washing tub (3). A water softening device (11) is arranged/located along the main fresh-water supply circuit (10) so as to be crossed by the fresh water flowing from the water mains to the detergent dispensing assembly (9) and/or the washing tub (3) and is structured for reducing the hardness degree of the fresh water supplied to the washing tub (3). The laundry washing machine (1) is characterized in that the detergent dispensing assembly (9) and the water softening device (11) are provided with respective loading inlets or mouths (19; 32*a*) which are exposed or exposable to the outside on the front wall (2*a*) of casing (2), and are arranged inside the casing (2) so that the loading inlet or mouth (19*a*) of the detergent dispensing assembly (9) and the loading inlet or mouth (32*a*) of the water softening device (11) are located on the front wall (2*a*) of the casing (2), on opposite sides of the vertical center-plane (M) of the casing (2).

18 Claims, 8 Drawing Sheets

(56) References Cited

U.S. PATENT DOCUMENTS 4,090,963 A * 5/1978 Grout ..... A47L 15/4229
137/513.5

6,598,611 B1 * 7/2003 Durazzani ..... A47L 15/0084
134/201

* cited by examiner

LAUNDRY WASHING MACHINE

TECHNICAL FIELD

Aspects of the present invention relates to a laundry washing machine.

In particular, aspects of the present invention relate to a front-loading home laundry washing machine, to which the following description refers purely by way of example without this implying any loss of generality.

BACKGROUND

As is known, currently marketed front-loading home laundry washing machines generally comprise: a substantially parallelepiped-shaped outer boxlike casing structured for resting on the floor; a substantially bell-shaped washing tub which is suspended in floating manner inside the casing, directly facing a laundry loading/unloading through opening realized in the front wall of the casing; a substantially cylindrical elastically-deformable bellows, which connects the front opening of the washing tub to a laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; a substantially cylindrical, bell-shaped revolving drum structured for housing the laundry to be washed, and which is arranged inside the washing tub with its concavity facing the laundry loading/unloading opening and is supported in axially rotating manner so as to be able to freely rotate about its substantially horizontally-oriented longitudinal axis; and finally an electrically-powered motor assembly which is structured for driving into rotation the revolving drum about its longitudinal axis inside the washing tub.

Like other home laundry washing machines, this type of laundry washing machine is furthermore provided with a detergent dispensing assembly which is generally located inside the boxlike casing, immediately above the washing tub, and is structured for selectively feeding into the washing tub, according to the washing cycle manually-selected by the user via a control panel generally located on the front wall of the boxlike casing, a given amount of detergent, softener and/or other washing agent suitably mixed with fresh water arriving from the water mains; and with a fresh-water supply circuit structured for selectively drawing fresh water from the water mains according to the washing cycle manually-selected by the user, and channeling said water into the detergent dispensing assembly or directly into the washing tub.

The detergent dispensing assembly, in turn, generally comprises a detergent drawer which is usually divided into a number of detergent compartments each structured for being manually fillable with a corresponding detergent product, and which is fitted/inserted in manually extractable manner into a completely recessed drawer housing whose entrance is located on front wall of the boxlike casing, above the porthole door, and whose bottom wall directly communicates with the inside of the washing tub via a connecting duct.

The fresh-water supply circuit is structured for drawing fresh water from the water mains and selectively and alternatively channeling said water into any one of the detergent compartments of the detergent drawer, so as to selectively flush the detergent, softener or other washing agent out of the compartment and down on the bottom of the drawer housing, and afterwards sweep the detergent, softener or other washing agent away from the bottom of the drawer housing directly into the washing tub.

As is known the hardness of the fresh water used for washing deeply negatively influences the cleaning efficiency of the detergents and softeners used in the washing cycle, thus the user is usually requested to considerably increase, when the hardness degree of the tap water is too high, the amount of detergent and softener used in the washing cycle and/or to mix the detergent with a given amount of very expensive, generally polycarboxylates-based, water-softening chemical product.

To solve this problem the European patent application No. 1085118 discloses a front-loading home laundry washing machine provided with an internal water softening device capable of reducing, during each washing cycle, the hardness degree of the tap water used in the pre-washing and washing phases of the washing cycle. This water softening device uses ion-exchange resins to restrain calcium and magnesium ions (Ca++ and Mg++) dissolved in the fresh water channeled to the washing tub, and uses brine (i.e. salt water) to periodically regenerate these ion-exchange resins. Salt water, in fact, is able to remove from the ion-exchange resins the calcium and magnesium ions previously combined/fixed to said resins.

Integration of the salt reservoir on the back of the detergent drawer has brought to a very complicated detergent-dispenser structure with a consequent significant increase in the detergent dispenser overall production cost.

Moreover the brine accidentally coming out of the salt reservoir accumulates on the bottom of the drawer housing which is in direct communication with the upper portion of the washing tub, thus the brine can reach quite easily the outer surface of the revolving drum with all problems concerned. The revolving drum, in fact, is generally made of metal material and gets rusty very quickly in presence of brine.

Last but not less important, the capacity of the salt reservoir on the back of the detergent drawer is too limited for the everyday-use typical of a traditional home laundry washing machine. It is unacceptable for a normal user to refill the salt reservoir every 3-4 washing cycles.

An aim of the present invention is therefore to realize an internal water softening device designed to eliminate the drawbacks referred above.

SUMMARY

In compliance with the above aims, according to aspects of the present invention, there is provided a laundry washing machine comprising an outer casing and, inside said outer casing, a washing tub which is arranged inside the casing with its opening or outer casing, a washing tub which is arranged inside the casing with its opening or mouth directly facing a laundry loading/unloading opening which is realized in the front wall of the casing substantially astride of (i.e. extending across) a vertical center-plane of the casing, a rotatable drum which is arranged in an axially rotating manner inside the washing tub and which is structured for receiving the laundry to be washed, a detergent dispensing assembly which is structured for supplying detergent into the washing tub, a main fresh-water supply circuit which is structured for selectively channeling a flow of fresh water from the water mains towards the detergent dispensing assembly and/or the washing tub, and a water softening device which is arranged/located along the main fresh-water supply circuit so as to be crossed by the fresh water flowing from the water mains to the detergent dispensing assembly and/or the washing tub and which is structured for reducing the hardness degree of the fresh water supplied to the washing tub; wherein the detergent dispensing assembly and the water softening device are provided with respective loading inlets or mouths which are exposed or exposable to the outside on the front wall of casing, and wherein the loading inlet or mouth are located on the front wall of the casing, on opposite sides of the vertical center-plane of the casing.

In other words, there is provided a laundry washing machine comprising an outer casing and, inside said outer casing, a washing tub which is arranged inside the casing with its opening or mouth directly facing a laundry loading/unloading opening which is realized in the front wall of the casing substantially astride of a vertical center-plane of the casing, a rotatable drum which is arranged in axially rotating manner inside the washing tub and which is structured for receiving the laundry to be washed, a detergent dispensing assembly which is structured for supplying detergent into the washing tub, a main fresh-water supply circuit which is structured for selectively channeling a flow of fresh water from the water mains towards the detergent dispensing assembly and/or the washing tub, and a water softening device which is arranged/located along the main fresh-water supply circuit so as to be crossed by the fresh water flowing from the water mains to the detergent dispensing assembly and/or the washing tub and which is structured for reducing the hardness degree of the fresh water supplied to the washing tub; wherein the detergent dispensing assembly and the water softening device are provided with respective loading inlets or mouths which are exposed or exposable to the outside on the front wall of casing, and are arranged inside the casing so that the loading inlet or mouth of the detergent dispensing assembly and the loading inlet or mouth of the water softening device are located on the front wall of the casing, on opposite sides of the vertical center-plane of the casing.

In compliance with the above aims, according to aspects of the present invention there is provided a laundry washing machine comprising an outer casing and, inside said outer casing, a washing tub which is arranged inside the casing with its opening or mouth directly facing a laundry loading/unloading opening which is realized in the front wall of the casing substantially astride of (i.e. extending across) a vertical center-plane of the casing, a rotatable drum which is arranged in axially rotating manner inside the washing tub and which is structured for receiving the laundry to be washed, a detergent dispensing assembly which is structured for supplying detergent into the washing tub, a main fresh-water supply circuit which is structured for selectively channeling a flow of fresh water from the water mains towards the detergent dispensing assembly and/or the washing tub, and a water softening device which is arranged/located along the main fresh-water supply circuit so as to be crossed by the fresh water flowing from the water mains to the detergent dispensing assembly and/or the washing tub and which is structured for reducing the hardness degree of the fresh water supplied to the washing tub; wherein the detergent dispensing assembly and the water softening device are provided with respective loading inlets or mouths which are exposed or exposable to the outside on the front wall of casing, and an appliance control panel is provided which is located on the front wall of the casing, between the loading inlet or mouth of the detergent dispensing assembly and the loading inlet or mouth of the water softening device.

Preferably, though not necessarily, the laundry washing machine is furthermore characterized in that the appliance control panel is arranged on the front wall of the casing astride of the vertical center-plane of the casing.

Preferably, though not necessarily, the laundry washing machine is furthermore characterized in that the loading inlet or mouth of the detergent dispensing assembly and the loading inlet or mouth of the water softening device are both arranged on the front wall of the casing, above the laundry loading/unloading opening.

In other words, the laundry washing machine is furthermore characterized in that the detergent dispensing assembly and the water softening device are arranged inside the casing so that the respective loading inlets or mouths are both arranged on the front wall of the casing, above the laundry loading/unloading opening.

Preferably, the loading inlet or mouth of the detergent dispensing assembly and the loading inlet or mouth of the water softening device are both arranged above the laundry loading/unloading opening provided at the front wall of the casing.

In other words, the detergent dispensing assembly and the water softening device are arranged inside the casing so that the respective loading inlets or mouths are both arranged above the laundry loading/unloading opening provided at the front wall of the casing.

Preferably, though not necessarily, the laundry washing machine is furthermore characterized in that the loading inlet or mouth of the detergent dispensing assembly and the loading inlet or mouth of the water softening device are substantially horizontally aligned to one another, on opposite sides of the vertical center-plane of the casing.

In other words, the laundry washing machine is furthermore characterized in that the detergent dispensing assembly and the water softening device are arranged inside the casing so that the respective loading inlets or mouths are substantially horizontally aligned to one another, on opposite sides of the vertical center-plane of the casing.

Preferably, though not necessarily, the laundry washing machine is furthermore characterized in that the loading inlet or mouth of the detergent dispensing assembly and the loading inlet or mouth of the water softening device are arranged on the front wall of the casing substantially in specular position to one another, on opposite sides of the vertical center-plane of the casing.

In other words, the laundry washing machine is furthermore characterized in that the detergent dispensing assembly and the water softening device are arranged inside the casing so that the respective loading inlets or mouths are arranged on the front wall of the casing substantially in specular position to one another, on opposite sides of the vertical center-plane of the casing.

Preferably, though not necessarily, the laundry washing machine is furthermore characterized in that the loading inlet or mouth of the detergent dispensing assembly and the loading inlet or mouth of the water softening device are arranged on the front wall of the casing each close to, or substantially on a respective upper corner of the front wall of the casing.

In other words, the laundry washing machine is furthermore characterized in that the detergent dispensing assembly and the water softening device are arranged inside the casing so that the respective loading inlets or mouths are arranged on the front wall of the casing each close to, or substantially on a respective upper corner of the front wall of the casing.

Preferably, though not necessarily, the laundry washing machine is furthermore characterized by also comprising an appliance control panel which is located on the front wall of the casing, between the loading inlet or mouth of the detergent dispensing assembly and the loading inlet or mouth of the water softening device.

Preferably, though not necessarily, the laundry washing machine is furthermore characterized in that the appliance control panel is arranged on the front wall of the casing astride of the vertical center-plane of the casing.

Preferably, though not necessarily, the laundry washing machine is furthermore characterized in that the appliance control panel is structured so as to allow the user to manually select a desired washing cycle that uses softened fresh water.

Preferably, though not necessarily, the laundry washing machine is furthermore characterized in that the detergent dispensing assembly comprises a detergent container which is fillable with a given quantity of detergent, softener and/or other washing agent, and which is housed inside the casing into a corresponding external housing; the front wall of the casing being provided with a corresponding pass-through opening through which the detergent container is accessible by the user.

Preferably, though not necessarily, the laundry washing machine is furthermore characterized in that the detergent dispensing assembly comprises a detergent drawer which is fillable with a given quantity of detergent, softener and/or other washing agent, and which is fitted/inserted in manually extractable manner into a corresponding completely recessed, drawer housing which extends inside the casing and communicates with the outside of the casing via a front entrance or opening realized on the front wall of said casing.

Preferably, though not necessarily, the laundry washing machine is furthermore characterized in that the detergent dispensing assembly furthermore comprises a detergent flush circuit which is connected to the main fresh-water supply circuit and which is structured for selectively spilling/pouring a given amount of fresh water arriving from the water mains so as to flush the detergent, softener or other washing agent down into the washing tub.

Preferably, though not necessarily, the laundry washing machine is furthermore characterized in that the water softening device comprises: a water-softening agent container which is crossed by the fresh water flowing along the main fresh-water supply circuit and which is filled with a water softening agent able to reduce the hardness degree of the fresh water flowing through the same water-softening agent container, and a regeneration-agent reservoir which is fluidically connected to the water-softening agent container, and which is structured to receive a salt or other regeneration agent for performing a regeneration of the water softening function of the water softening agents stored into the water-softening agent container; the regeneration-agent reservoir being provided with a loading inlet or mouth forming the loading inlet or mouth of the water softening device.

Preferably, though not necessarily, the laundry washing machine is furthermore characterized in that the regeneration-agent reservoir comprises a regeneration-agent container which is manually fillable with a given quantity of regeneration agents and which is housed inside the casing into a corresponding external housing; the front wall of the casing being provided with a corresponding pass-through opening through which the regeneration-agent container is accessible by the user.

Preferably, though not necessarily, the laundry washing machine is furthermore characterized in that the regeneration-agent reservoir comprises a salt drawer which is dimensioned for being manually fillable with said given amount of salt grains or other water-softening chemical agent, and which is fitted/inserted in manually extractable manner into a corresponding completely recessed, drawer housing which, starting from the front wall of the casing, extends inside the casing and communicates with the outside of the casing via a front entrance or opening realized on the front wall of said casing.

Preferably, though not necessarily, the laundry washing machine is furthermore characterized in that the water softening device furthermore comprises a water supply circuit which is structured for channeling, on command, a given amount of fresh water into the regeneration-agent reservoir so to at least partly dissolve the salt or other regeneration agents stored therein and form a given amount of brine.

Preferably, though not necessarily, the laundry washing machine is furthermore characterized in that the water supply circuit of the water softening device is structured for spilling/pouring a dense shower of the water droplets by gravity directly into the regeneration-agent reservoir.

Preferably, though not necessarily, the laundry washing machine is furthermore characterized in that the water supply circuit of the water softening device either branches off from the main fresh-water supply circuit, or it is structured for being connectable to the water mains independently from the main fresh-water supply circuit.

Preferably, though not necessarily, the laundry washing machine is furthermore characterized in that the water softening device furthermore comprises a first water drain line which is structured for selectively draining the brine or fresh water out of the water-softening agent container and channeling said brine or fresh water directly into the washing tub, or into a drain sump that extends downwards from the bottom of the washing tub, or into a water filtering assembly that is interposed between the drain sump of the washing tub and the suction of a water circulating pump and of a water exhaust pump of the laundry washing machine, or into the water exhaust pump.

Preferably, though not necessarily, the laundry washing machine is furthermore characterized by also comprising a second fresh-water supply circuit which is structured for being connectable to the water mains independently from the main fresh-water supply circuit, and for selectively channeling the fresh water from the water mains to the detergent dispensing assembly and/or directly to the washing tub, bypassing the water softening device.

Preferably, though not necessarily, the laundry washing machine is furthermore characterized in that the main fresh-water supply circuit furthermore comprises a second water drain line which is structured for selectively rerouting the brine or fresh water flowing towards the detergent dispensing assembly into the washing tub, or into a drain sump that extends downwards from the bottom of the washing tub, or into a water filtering assembly that is interposed between the drain sump of the washing tub and the suction of a water circulating pump and of a water exhaust pump of the laundry washing machine, or into the water exhaust pump.

BRIEF DESCRIPTION OF DRAWINGS

Non-limiting embodiments of the present invention will now be described, by way of example, with reference to the accompanying drawings, in which.

DETAILED DESCRIPTION

Figure 1:
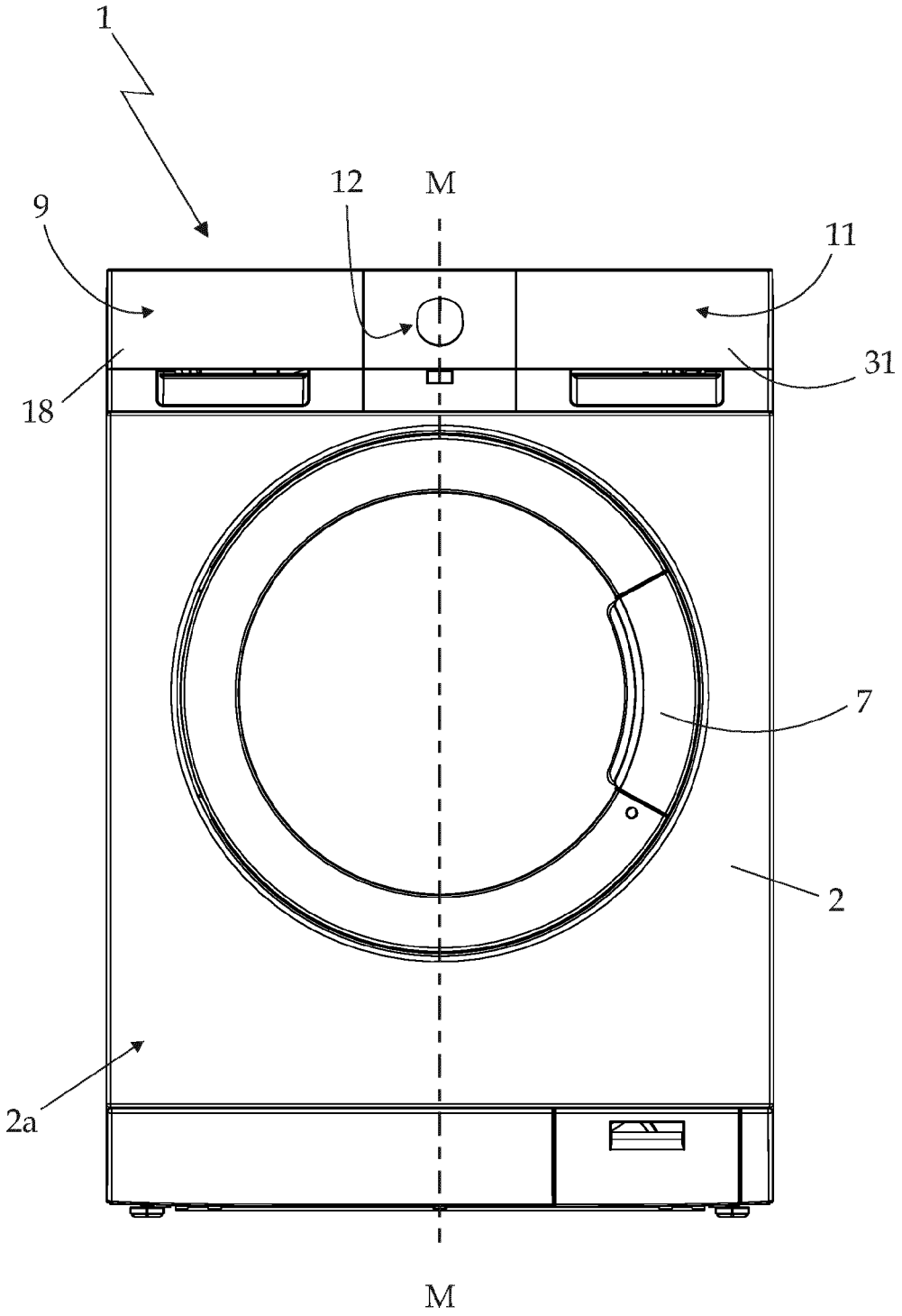
FIG. 1 is a front view of a front-loading, home laundry washing machine realized in accordance with the teachings of the present invention.

With reference to FIGS. 1 to 4, reference number 1 indicates as a whole a home laundry washing machine which comprises: a preferably, though not necessarily, substantially parallelepiped-shaped, rigid outer boxlike casing 2 which is structured for resting on the floor; a preferably substantially cylindrical, bell-shaped hollow washing tub 3 which is arranged inside the casing 2 with its opening or mouth directly facing a laundry loading/unloading pass-through opening realized in the front wall 2*a* of boxlike casing 2; a preferably substantially cylindrical, elastically-deformable bellows (not shown) watertight connecting the front opening or mouth of washing tub 3 to the laundry loading/unloading opening realized in the front wall 2*a* of casing 2; and a substantially cylindrical, bell-shaped revolving drum (not shown) structured for housing the laundry to be washed, and which is housed in axially rotating manner inside the washing tub 3 so as to be able to freely rotate about its longitudinal reference axis.

The laundry loading/unloading pass-through opening is realized on the front wall 2*a* of casing 2 astride of (i.e. extending across) the vertical center-plane M of the casing 2, and the washing tub 3 is arranged inside the boxlike casing 2 so that its longitudinal reference axis L preferably substantially rests on said vertical center-plane M and is preferably substantially horizontally-oriented. The revolving drum, in turn, is housed in axially rotating manner inside the washing tub 3 with its front opening directly faced/aligned to the laundry loading/unloading opening on front wall 2*a*, and the drum rotation axis is preferably arranged locally substantially coincident with the substantially horizontally-oriented longitudinal reference axis L of washing tub 3.

Furthermore in the example shown the hollow washing tub 3 is preferably suspended in floating manner inside the casing 2 via a suspension system preferably, though not necessarily, comprising a couple of upper coil springs 4 connecting the upper portion of the washing tub 3 to the top of the boxlike casing 2, and a plurality of lower vibration dampers 5 connecting the bottom portion of the washing tub 3 to the bottom of casing 2.

With reference to FIGS. 1 to 4, the laundry washing machine 1 furthermore comprises:

- a porthole door 7 which is hinged to the front wall 2*a* of casing 2 to rotate about a preferably, though not necessarily, vertically-oriented reference axis to and from a closing position in which the peripheral border of the porthole door 7 rests completely on front wall 2*a* for closing the laundry loading/unloading opening and watertight sealing the washing tub 3;
- an electrically-powered motor assembly (not shown) which is structured for driving into rotation the revolving drum about its longitudinal reference axis inside the washing tub 3;
- a detergent dispensing assembly 9 which is housed inside the casing 2 in easily reachable manner by the user, and is structured for selectively feeding into the washing tub 3, according to the selected washing cycle, a given amount of detergent, softener and/or other washing agent suitably mixed with the fresh water arriving from the water mains, or even simply a given amount of fresh water arriving from the water mains; and
- a fresh-water supply circuit 10 which is structured for being connectable to the water mains and for selectively channeling the fresh water from the water mains to the detergent dispensing assembly 9 and/or to the washing tub 3 preferably while controlling/regulating the flow of fresh water towards the detergent dispensing assembly 9 and/or the washing tub 3.

In addition to the above, with reference to FIGS. 1 to 6, the laundry washing machine 1 furthermore comprises, inside casing 2, an internal water softening device 11 which is arranged/located along the fresh-water supply circuit 10, so as to be crossed by the fresh water flowing from the water mains to the detergent dispensing assembly 9 and/or the washing tub 3, and is structured for selectively reducing, during each washing cycle, the hardness degree of the fresh water drawn from the water mains and channeled to the detergent dispensing assembly 9 and/or to the washing tub 3.

The water softening device 11 is internally provided with a given amount of water softening agent which is able to reduce the hardness degree of the fresh water flowing through the same water softening device, and a given amount of consumable salt or other regeneration agent which is able to regenerate the water softening function of the water softening agent.

Figure 2:
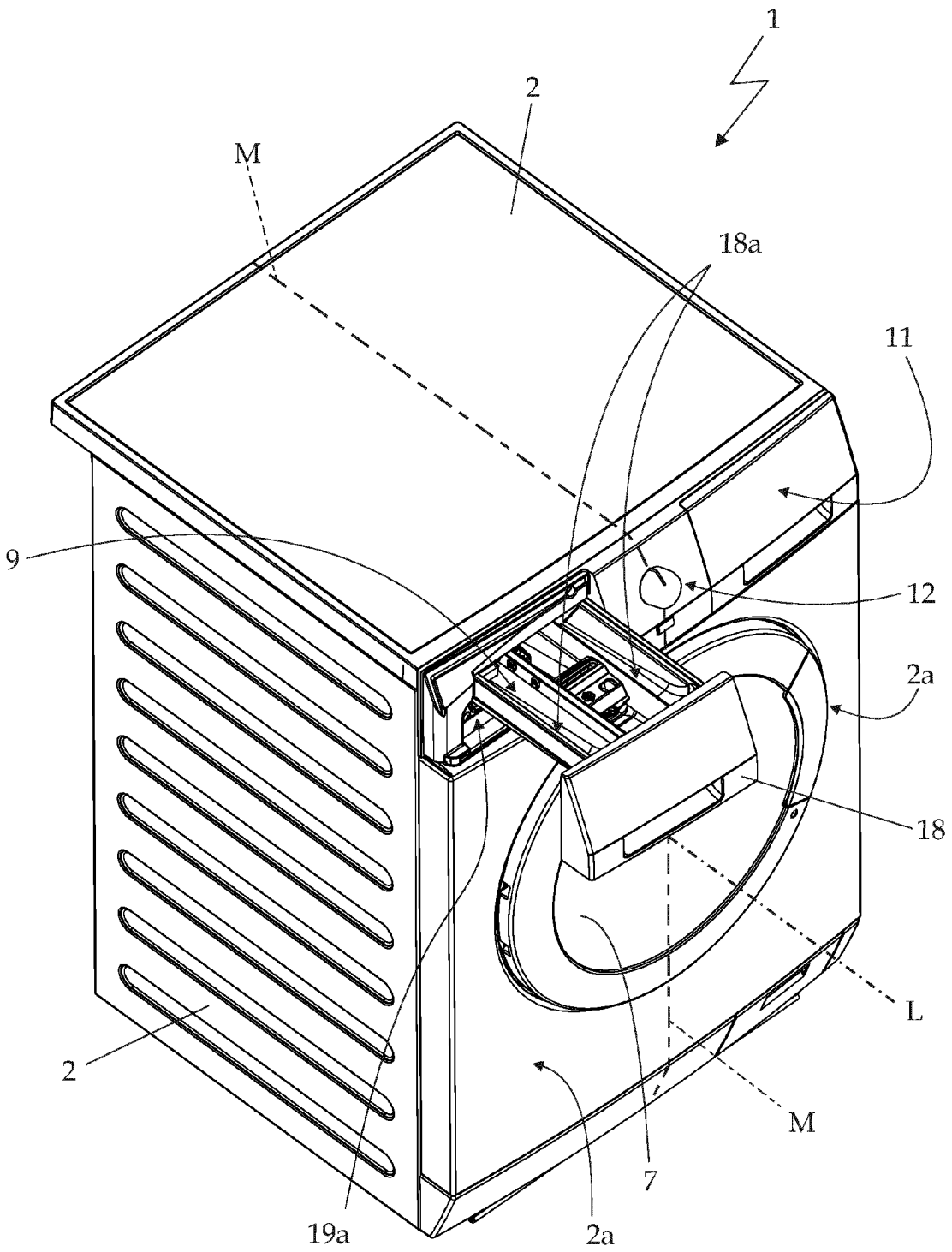
FIG. 2 is a perspective view of the FIG. 1 laundry washing machine in different working configuration.
Figure 3:
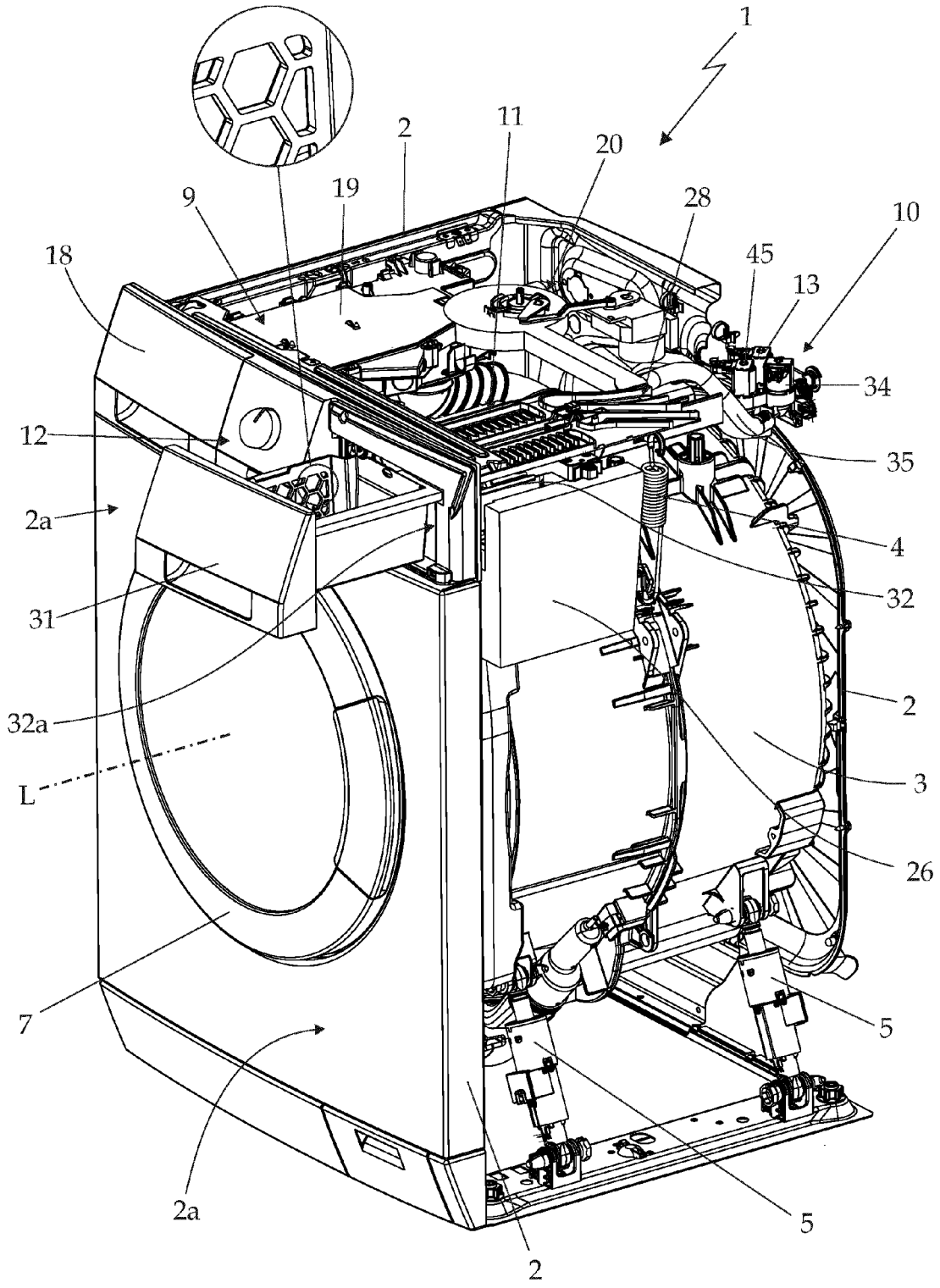
FIG. 3 is a further perspective view of FIG. 1 laundry washing machine with parts in section and parts removed for clarity.
Figure 4:
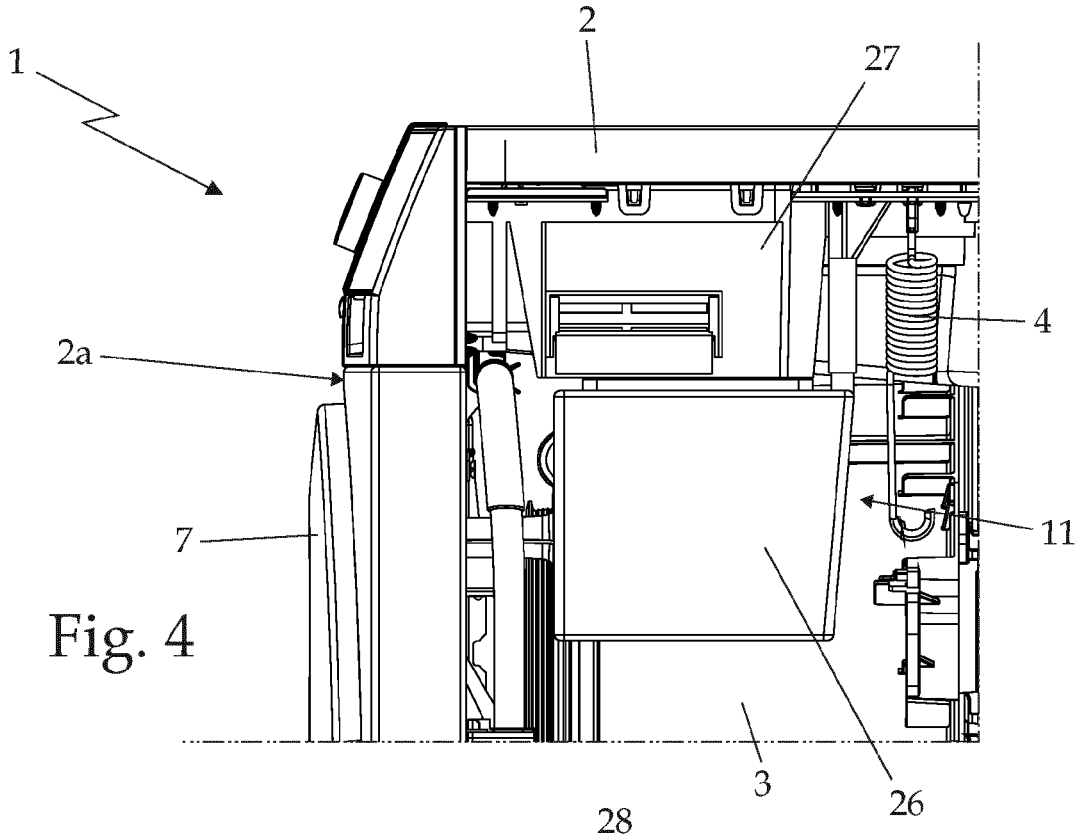
FIG. 4 is a side view of the FIG. 1 laundry washing machine with parts removed for clarity.
Figure 5:
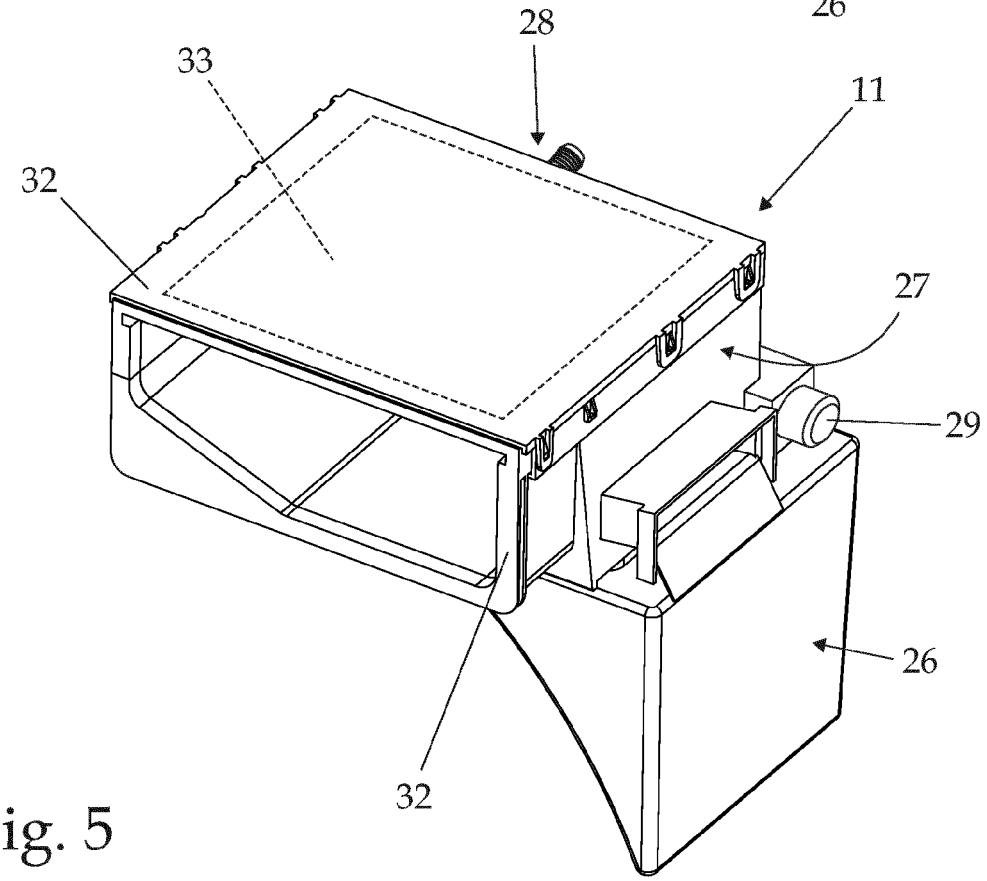
FIG. 5 is a perspective view of the internal water softening device water softening device of the FIG. 1 laundry washing machine with parts removed for clarity.

With reference to FIGS. 1, 2 and 3, the detergent dispensing assembly 9 and the water softening device 11 are both provided with a loading inlet or mouth which is exposed or exposable to the outside on the front wall 2*a* of casing 2, so as to allow the user to timely fill up the detergent dispensing assembly 9 and the water softening device 11, respectively, with the requested detergent, softener and/or other washing agent and with the requested salt or other regeneration agent. The detergent dispensing assembly 9 and the water softening device 11 are furthermore arranged inside the boxlike casing 2 so that the loading inlet or mouth of the detergent dispensing assembly 9 and the loading inlet or mouth of the water softening device 11 are located on the front wall 2*a* of boxlike casing 2, on opposite sides of the vertical center-plane M of the boxlike casing 2.

In the example shown, in particular, the detergent dispensing assembly 9 and the water softening device 11 are preferably arranged inside the boxlike casing 2 so that the two loading inlets or mouths are both arranged on front wall 2*a*, above the laundry loading/unloading opening of the casing 2.

Preferably, though not necessarily, the detergent dispensing assembly 9 and the water softening device 11 are furthermore arranged inside the boxlike casing 2 so that the respective loading inlets or mouths are substantially horizontally aligned to one another, on opposite sides of the vertical center-plane M of the casing 2. Moreover, the loading inlet or mouth of the detergent dispensing assembly 9 and the loading inlet or mouth of the water softening device 11 are preferably arranged on the front wall 2*a* of casing 2 in specular (symmetric) position to one another, on opposite sides of the vertical center-plane M of the same casing 2.

In the example shown the loading inlet or mouth of the detergent dispensing assembly 9 and the loading inlet or mouth of the water softening device 11 are preferably arranged each close to, or substantially on a respective upper corner of the front wall 2*a* of casing 2.

With reference to FIGS. 1, 2 and 3, the laundry washing machine 1 is furthermore provided with an appliance control panel 12 which is preferably located on front wall 2*a*, between the loading inlet or mouth of the detergent dispensing assembly 9 and the loading inlet or mouth of the water softening device 11, and preferably also astride of (i.e. extending across) the vertical center-plane M of the casing 2.

In other words, the loading inlet or mouth of the detergent dispensing assembly 9 and the loading inlet or mouth of the water softening device 11 are preferably located on opposite sides of the appliance control panel 12 which is substantially astride of the vertical center-plane M of the casing 2.

Figure 6:
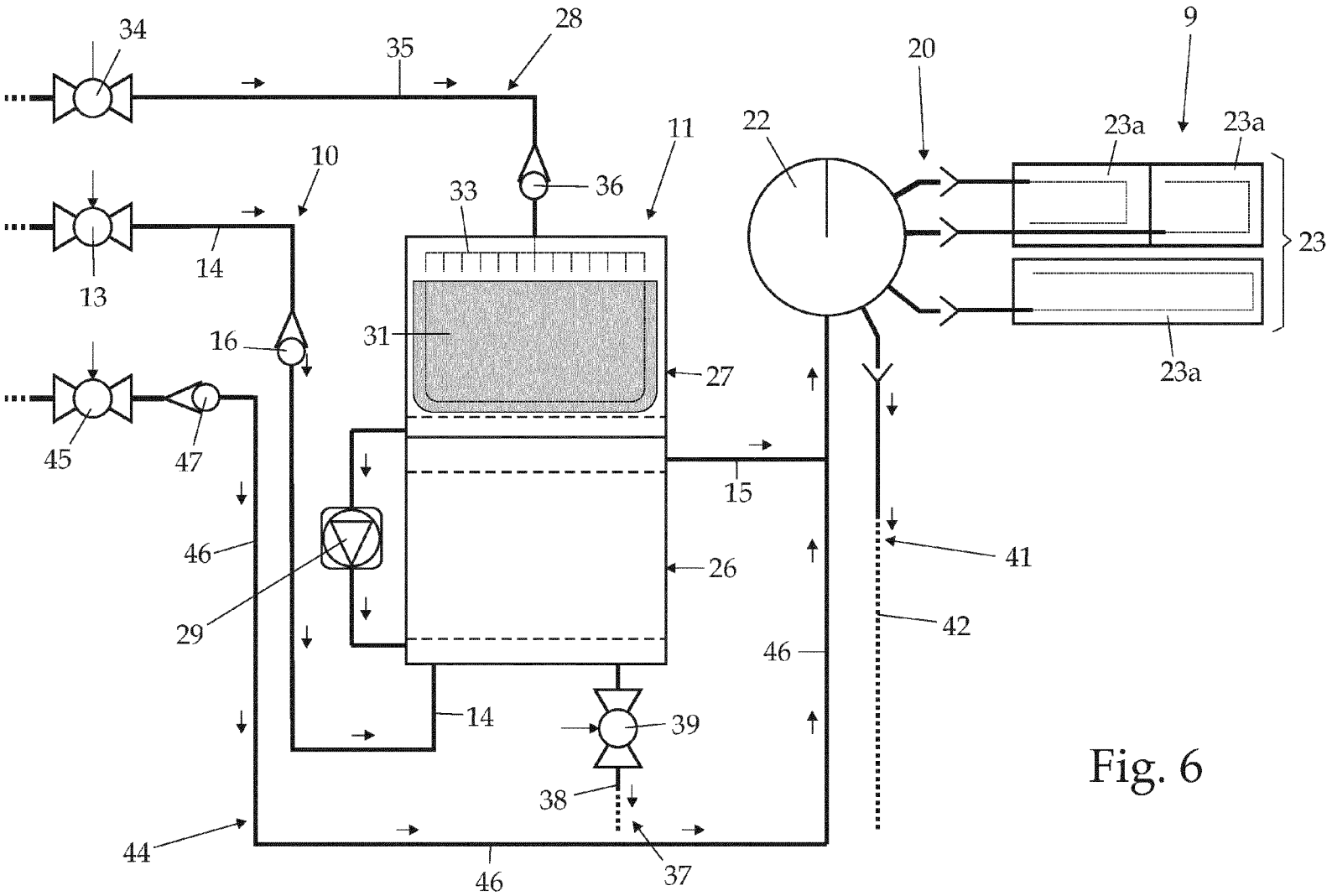
FIG. 6 is a schematic view of the FIG. 4 water softening device.

With reference to FIGS. 3 and 6, in the example shown, in particular, the fresh-water supply circuit 10 preferably comprises an electrically-controlled on-off valve 13 which is arranged/interposed between the water mains and the water softening device 11, and is able to control/regulate the flow of fresh water from the water mains towards the water softening device 11; a first hosepipe 14 connecting the on-off valve 13 directly to the inlet of the internal water softening device 11; and a second hosepipe 15 connecting the outlet of the internal water softening device 11 to the detergent dispensing assembly 9 and/or to the washing tub 3. In the example shown, in particular, the electrically-controlled on-off valve 13 is preferably attached to the rear wall of casing 2.

Furthermore the fresh-water supply circuit 10 is preferably also provided with a one-way valve 16 which is located immediately downstream of the on-off valve 13, i.e. between the on-off valve 13 and the inlet of the water softening device 11, and is structured to allow the fresh water to only flow along the hosepipe 14 from the water mains to the water softening device 11 and not vice versa. The internal water softening device 11 is therefore located downstream of the electrically-controlled on-off valve 13, and also downstream of the one-way valve 16 if present.

With reference to FIGS. 1, 2 and 3, the detergent dispensing assembly 9, in turn, is preferably housed inside the boxlike casing 2 between the washing tub 3 and the top wall of casing 2, so as to emerge from the front wall 2*a* of boxlike casing 2 above the laundry loading/unloading opening of casing 2, and preferably also beside the appliance control panel 12 which is preferably located on front wall 2*a* of casing 2, above the laundry loading/unloading opening and immediately beneath the top wall of casing 2.

In particular, the detergent dispensing assembly 9 preferably comprises a detergent container 18 which is manually fillable with a given quantity of detergent, softener and/or other washing agent and which is housed inside the boxlike casing 2 into a corresponding external housing 19, and the front wall 2*a* of the boxlike casing 2 is provided with a corresponding pass-through opening through which the detergent container 18 is accessible by the user.

The quantity of detergent, softener and/or other washing agent stored into the detergent container 18 may be sufficient either for a single washing cycle or for several consecutive washing cycles.

The detergent dispensing assembly 9 preferably comprises a detergent drawer 18 which is manually fillable with a given quantity of detergent softener and/or other washing agent and is fitted/inserted in manually extractable manner into a completely recessed drawer housing 19 which, starting from front wall 2*a* of casing 2, extends substantially horizontally inside the boxlike casing 2 while remaining above the washing tub 3, and communicates with the outside of casing 2 via a front entrance or opening 19*a* realized on front wall 2*a* of casing 2 immediately above the laundry loading/unloading opening.

The detergent drawer 18 is therefore manually movable inside the drawer housing 19 in a preferably substantially horizontally-oriented, displacement direction between a working position (see FIG. 3) in which the detergent drawer 18 is completely recessed inside the drawer housing 19 preferably, while at the same time, closing the front entrance or opening 19*a* of the same drawer housing 19, and a completely extracted position (see FIG. 2) in which the detergent drawer 18 partly juts out from the front wall 2*a* of casing 2 through the front entrance or opening 19*a* of the drawer housing 19.

In the example shown, in particular, the drawer housing 19 is preferably arranged inside casing 2 so as to locate its front entrance or opening 19*a* substantially on the upper left corner of the front wall 2*a*; whereas the detergent drawer 18 is preferably movable inside the drawer housing 19 along a substantially horizontally-oriented, displacement direction which is also locally substantially perpendicular to the front wall 2*a* of casing 2.

With reference to FIGS. 3 and 6, the detergent dispensing assembly 9 furthermore comprises a drawer flush circuit 20 which is connected to the fresh-water supply circuit 10 and is structured for selectively spilling/pouring a given amount of fresh water arriving from the water mains, so as to flush a given quantity of the detergent, softener or other washing agent inside the washing tub 3.

In the example shown, in particular, the detergent dispensing assembly 9 preferably comprises a drawer flush circuit 20 which is connected to the fresh-water supply circuit 10 and is structured for selectively spilling/pouring a given amount of fresh water arriving from the water mains directly into the detergent drawer 18, so as to flush the detergent, softener or other washing agent out of the same detergent drawer 18 and down into the bottom portion of drawer housing 19; and a connecting duct which connects the bottom portion of drawer housing 19 to the inside of washing tub 3 for channeling this mixture of water and detergent, softener or other washing agent into the same washing tub 3.

The inlet of the drawer flush circuit 20 of detergent dispensing assembly 9 is therefore fluidically connected to the fresh-water supply circuit 10, namely to the hosepipe 15 of the fresh-water supply circuit 10, and the water softening device 11 is located upstream of the drawer flush circuit 20 so as to be crossed by the fresh water flowing from the water mains towards the drawer flush circuit 20.

In the example shown, in particular, the bottom portion (not shown) of drawer housing 19 is preferably shaped/structured so as to form a substantially funnel-shaped catchment basin which collects the mixture of water and detergent, softener or other washing agent and which communicates with the inside of washing tub 3 via a connecting duct which is preferably, though not necessarily, connected to the upper portion of washing tub 3.

The drawer flush circuit 20, in turn, is preferably structured for spilling/pouring a dense shower of water droplets by gravity into the detergent drawer 18.

In addition to the above, with reference to FIG. 2, the detergent drawer 18 is preferably, though not necessarily, divided into a number/plurality of detergent compartments 18*a* (three detergent compartments in the example shown) each of which is manually fillable with a respective washing agent; and the drawer flush circuit 20 is structured for spilling/pouring the softened fresh water arriving from the fresh-water supply circuit 10 selectively and alternatively into any one of the detergent compartments 18*a* of the detergent drawer 18, so as to selectively flush the detergent, softener or other washing agent out of the same compartment 18*a* and down into the funnel-shaped catchment basin on the bottom of drawer housing 19.

In other words, the drawer flush circuit 20 of detergent dispensing assembly 9 is provided with an electrically-controlled hydraulic distributor 22 or similar valve assembly, which is arranged between the fresh-water supply circuit 10 and the various detergent compartments 18*a* of the detergent drawer 18, i.e. between the outlet of the hosepipe 15 and the various detergent compartments 18*a* of the detergent drawer 18, and is structured for selectively and alternatively channeling the softened fresh water arriving from the fresh-water supply circuit 10 towards the various detergent compartments 18*a* of detergent drawer 18. Thus the drawer flush circuit 20 is preferably, though not necessarily, structured for spilling/pouring a dense shower of water droplets by gravity into the various detergent compartments 18*a* of the detergent drawer 18.

With reference to FIGS. 3 and 6, in the example shown, in particular, the drawer flush circuit 20 preferably comprises a sprinkler head 23 which is associated to the drawer housing 19 so as to be located immediately above the detergent drawer 18 when the latter is completely inserted/recessed into the same drawer housing 19, and which is provided with a number (three in the example shown) of shower-making portions/sections 23*a* each of which is preferably substantially aligned to a corresponding detergent compartment 18*a* of the detergent drawer 18 and is structured for feeding a dense shower of water droplets by gravity into the detergent compartment 18*a* located immediately beneath. The electrically-controlled hydraulic distributor or valve assembly 22 is located upstream of the sprinkler head 23, i.e. between the sprinkler head 23 and the fresh-water supply circuit 10, and is structured for channeling the softened fresh water arriving from the fresh-water supply circuit 10 selectively and alternatively towards the various shower-making sections/portions 23*a* of the sprinkler head 23.

Preferably, the electrically-controlled hydraulic distributor 22 is provided with a water inlet fluidically connected to the fresh-water supply circuit 10, i.e. to hosepipe 15, and a number (three in the example shown) of water outlets each fluidically connected to a respective shower-making section/portion 23*a* of the sprinkler head 23, and it is structured to selectively and alternatively channel the fresh water arriving from the fresh-water supply circuit 10 to the various shower-making sections/portions 23*a* of the sprinkler head 23.

In other words, the softened fresh water coming out from the water softening device 11 arrives to the hydraulic distributor 22 which channels/directs said softened fresh water selectively and alternatively towards one or more of the shower-making sections/portions 23*a* of the sprinkler head 23.

In the example shown, in particular, each shower-making section/portion 23*a* of sprinkler head 23 is preferably locally vertically aligned to a respective detergent compartment 18*a* of detergent drawer 18, and is preferably structured for feeding a dense shower of water droplets exclusively into the detergent compartment 18*a* located immediately beneath.

With reference to FIGS. 1 to 5, likewise the detergent dispensing assembly 9, the internal water softening device 11 is preferably housed inside the boxlike casing 2 between the washing tub 3 and the top wall of casing 2, so as to emerge from the front wall 2*a* of the boxlike casing 2 above the laundry loading/unloading opening of casing 2, and preferably also beside the appliance control panel 12 opposite to the detergent dispensing assembly 9.

The water softening device 11 furthermore basically comprises a water-softening agent container 26 and a regeneration-agent reservoir 27.

The water-softening agent container 26 is crossed by the fresh water flowing along the fresh-water supply circuit 10, and is filled with a water softening agent able to reduce the hardness degree of the fresh water flowing through the same water-softening agent container 26. More in particular, in the example shown the water-softening agent container 26 has an inlet connected to hosepipe 14 of fresh-water supply circuit 10 and an outlet connected to hosepipe 15 of fresh-water supply circuit 10, so as to be crossed by the fresh water flowing from the water mains to the detergent dispensing assembly 9.

The water-softening agent container 26 is therefore fluidically interposed between the water mains and the detergent dispensing assembly 9, or more specifically between the water mains and the inlet of the drawer flush circuit 20 of the detergent dispensing assembly 9, so as to be crossed by the fresh water flowing from the water mains to the inlet of drawer flush circuit 20.

The regeneration-agent reservoir 27 instead is fluidically connected to the water-softening agent container 26 and is structured for receiving a given quantity of salt or other regeneration agent which is able to regenerate the water softening function of the water softening agents stored inside the water-softening agent container 26.

The water-softening agent container 26 and the regeneration-agent reservoir 27 are both housed inside the casing 2, and the regeneration-agent reservoir 27 is furthermore preferably arranged inside the boxlike casing 2 horizontally aligned to the detergent dispensing assembly 9 in a direction locally substantially parallel to the front wall 2*a* of casing 2, so that both the detergent dispensing assembly 9 and the regeneration-agent reservoir 27 of the water softening device 11 are directly exposed or exposable to the outside on front wall 2*a* one spaced beside the other, for being independently accessible by the user at any moment.

In other words, the regeneration-agent reservoir 27 of water softening device 11 is housed inside the boxlike casing 2 substantially horizontally aligned to the drawer housing 19 and is provided with a corresponding loading inlet or mouth which is exposed or exposable to the outside of the boxlike casing 2 spaced beside the loading inlet or mouth of the detergent dispensing assembly 9, i.e. spaced beside the front entrance or opening 19*a* of the drawer housing 19. This independent loading inlet or mouth is suitable for loading the salt or other regeneration agents inside the regeneration-agent reservoir 27.

With reference to FIGS. 1 to 6, in the example shown, in particular, the water softening device 11 preferably comprises:

a water-softening agent container 26 which is filled with a given amount of ion-exchange resins (not shown) capable to restrain the calcium and/or magnesium ions (Ca++ and Mg++) dissolved in the fresh water flowing across the same water-softening agent container 26, and which is located along the fresh-water supply circuit 10 so as to be crossed by the fresh water directed towards the detergent dispensing assembly 9 and/or the washing tub 3; and an outside-accessible regeneration-agent reservoir 27 which is structured for receiving a given amount (for example half a Kilo or one Kilo) of salt grains (Sodium Chloride) or similar regeneration chemical agent, and is housed inside the boxlike casing 2 preferably horizontally aligned to the drawer housing 19 of detergent dispensing assembly 9 in a direction substantially parallel to the front wall 2*a* of casing 2, so to emerge from a corresponding pass-through opening realized on the front wall 2*a* of the boxlike casing 2 spaced beside the entrance/front opening 19*a* of the drawer housing 19.

The water-softening agent container 26, hereinafter also referred to as the resin container 26, is therefore arranged upstream of the hydraulic distributor 22 of detergent dispensing assembly 9, so as to be crossed by the fresh water flowing from the water mains to the inlet of drawer flush circuit 20, and the ion-exchange resins (not shown) stored into the water-softening agent container 26 form the water softening agents of the water softening device 11. Moreover in the example shown the water-softening agent container 26 is preferably located immediately beneath the regeneration-agent reservoir 27.

With reference to FIGS. 3 to 6, in addition to the above, the internal water softening device 11 furthermore comprises:

a water supply circuit 28 which is structured for channelling, on command, a given amount of fresh water into the regeneration-agent reservoir 27 so to at least partly dissolve the salt or other regeneration agents stored therein and form a given amount of brine (i.e. of salt water); and an electrically-powered brine-circulating pump 29 which is interposed between the water-softening agent container 26 and the regeneration-agent reservoir 27 and is structured for transferring/moving, when activated, the brine (i.e. the salt water) from the regeneration-agent reservoir 27 to the water-softening agent container 26, and for completely watertight sealing/isolating, when deactivated, the regeneration-agent reservoir 27 from the water-softening agent container 26 so as to prevent the brine (i.e. the salt water) stored in the regeneration-agent reservoir 27 from flowing towards the water-softening agent container 26.

With reference to FIG. 6, in the example shown, in particular, the water supply circuit 28 is preferably structured for being connectable to the water mains independently from the fresh-water supply circuit 10 and it is structured for selectively channeling a given amount of fresh water from the water mains directly into the regeneration-agent reservoir 27, so to at least partly dissolve the salt or other regeneration agents stored therein and form a given amount of brine (i.e. of salt water).

With reference to FIGS. 2 to 6, in particular, the regeneration-agent reservoir 27 of water softening device 11 comprises a regeneration-agent container 31 which is manually fillable with a given quantity of regeneration agents and which is housed inside the boxlike casing 2 into a corresponding second external housing 32, and the front wall 2*a* of the boxlike casing 2 is provided with a second pass-through opening through which the regeneration-agent container 31 is accessible by the user.

In the example shown, the regeneration-agent reservoir 27 preferably comprises a salt drawer 31 which is dimensioned for being manually fillable with said given amount of salt grains or other water-softening chemical agent, and is fitted/inserted in a manually extractable manner into a completely recessed second drawer housing 32 which, starting from front wall 2*a* of casing 2, extends substantially horizontally inside the boxlike casing 2 while remaining above the washing tub 3. Like the drawer housing 19 of detergent dispensing assembly 9, drawer housing 32 furthermore communicates with the outside of casing 2 via a corresponding front entrance or opening 32*a* which is realized on front wall 2*a* of casing 2 preferably so as to be locally substantially horizontally aligned to the entrance or front opening 19*a* of the drawer housing 19 of the detergent dispensing assembly 9.

The drawer housing 32 is furthermore spaced apart from drawer housing 19 of detergent dispensing assembly 9, so that drawer housing 19 and drawer housing 32 are located on opposite sides of the vertical center-plane M of boxlike casing 2, preferably in specular position to one another.

In the example shown, in particular, drawer housing 32 is preferably arranged inside casing 2 so as to locate its front entrance or opening 32*a* substantially on the upper right corner of the front wall 2*a;*

Like detergent drawer 18 of detergent dispensing assembly 9, salt drawer 31 of regeneration-agent reservoir 27 is manually movable inside the drawer housing 32 in a preferably substantially horizontally-oriented, displacement direction between a working position (see FIGS. 1 and 2) in which the salt drawer 31 is completely recessed inside the corresponding drawer housing 32 preferably while at the same time closing the front entrance or opening 32*a* of the same drawer housing 32, and a completely extracted position (see FIG. 3) in which the salt drawer 31 partly juts out from the front wall 2*a* of casing 2 through the front entrance or opening 32*a* of the corresponding drawer housing 32.

The displacement direction of salt drawer 31 is furthermore preferably locally substantially parallel to the displacement direction of detergent drawer 18, thus detergent drawer 18 and salt drawer 31 are able to jut out from the front wall 2*a* of casing 2 while remaining locally substantially parallel and spaced apart to one another.

The bottom portion of drawer housing 32 is furthermore preferably shaped/structured so as to form a substantially funnel-shaped catchment basin wherein the brine accumulates, and the suction of brine-circulating pump 29 directly communicates with the bottom of drawer housing 32 so that the brine-circulating pump 29 is able to selectively pump the brine from the funnel-shaped catchment basin of drawer housing 32 to the resin container 26.

The water supply circuit 28 of water softening device 11, in turn, is preferably structured for spilling/pouring a dense shower of the water droplets by gravity directly into the salt drawer 31 when the salt drawer 31 is completely inserted into the drawer housing 32, and the bottom and/or at least one of sidewalls of the salt drawer 31 have a water-permeable structure, so as to form the brine directly into the substantially funnel-shaped catchment basin on the bottom of drawer housing 32.

In the example shown, in particular, the bottom and/or at least one of the four sidewalls of salt drawer 31 have a meshed structure (so as to allow the fresh water spilled/poured into the salt drawer 31 to freely reach and at least partly dissolve the salt grains located inside the salt drawer 31 to form a given amount of brine which drops directly on the funnel-shaped catchment basin present on the bottom of drawer housing 32.

With reference to FIGS. 3 to 6, likewise the drawer flush circuit 20, the water supply circuit 28 of water softening device 11 preferably comprises:

- a sprinkler head 33 which is associated to the drawer housing 32 so as to be located immediately above the salt drawer 31 when the latter is completely inserted/recessed into the drawer housing 32, and it is provided with a shower-making portion/section that preferably, though not necessarily, extends above the whole salt drawer 31, and is structured for feeding a dense shower of water droplets by gravity into the salt drawer 31; and
- an electrically-controlled on-off valve 34 which is arranged/interposed between the water mains and the sprinkler head 33, and is able to control/regulate the flow of fresh water from the water mains towards the sprinkler head 33.

In the example shown, in particular, the electrically-controlled on-off valve 34 is preferably attached to the rear wall of casing 2 and it is directly connected to the sprinkler head 33 via a hosepipe 35 or the like.

The electrically-controlled on-off valve 34 is furthermore preferably, though not necessarily, dimensioned so as to have a nominal flow rate substantially equal to the nominal flow rate of the brine-circulating pump 29, so that the brine-circulating pump 29 is able to transfer/move the brine little by little from the regeneration-agent reservoir 27 to the resin container 26, thus minimising the permanency of the brine on the bottom of drawer housing 32.

Preferably, though not necessarily, the water supply circuit 28 of water softening device 11 furthermore comprises an additional one-way valve 36 which is located immediately downstream of the on-off valve 34, i.e. between the hosepipe 35 and the sprinkler head 33, and which is structured to allow the fresh water to only flow along hosepipe 35 from the water mains to the sprinkler head 33.

With reference to FIGS. 3 to 6, the resin container 26, in turn, is located inside the casing 2 preferably, though not necessarily, immediately beneath the regeneration-agent reservoir 27 and immediately beside the upper portion of washing tub 3, so as to internally face the front wall 2*a* of casing 2.

In other words, the resin container 26 is preferably located below the drawer housing 32 of detergent dispensing assembly 9, within an approximately triangular pocket seat or compartment delimited by the right sidewall of the boxlike casing 2, the upper portion of the washing tub 3 and the front wall 2*a* of casing 2.

Moreover, the resin container 26 is preferably realized as a completely stand-alone modular component-part or cartridge 26 which is provided with mechanical coupling members (not shown) structured for allowing a rigid and stable, though easily releasable, fastening of the stand-alone modular component-part or cartridge 26 directly to the bottom of the regeneration-agent reservoir 27, and with hydraulic connectors (not shown) structured for allowing the stable, though easily removable, fluidical connection of the stand-alone modular component-part or cartridge 26 to the fresh water supply circuit 10 and to the outlet of the brine-circulating pump 29.

A first hydraulic connector (not shown) of the stand-alone modular component-part or cartridge 26 is connected to hosepipe 14, so as to allow the inflow of the fresh water into the resin container 26. A second hydraulic connector (not shown) of the stand-alone modular component-part or cartridge 26 is connected to hosepipe 15 so as to allow the outflow of the fresh water from the resin container 26 towards the detergent dispensing assembly 9. A third hydraulic connector (not shown) of the stand-alone modular component-part or cartridge 26 is structured to directly communicate with the outlet of the brine-circulating pump 29 so as to allow the controlled inflow of the brine (i.e. the salt water) into the resin container 26.

With reference to FIG. 6, in the example shown the internal water softening device 11 is preferably, though not necessarily, also provided with a first water drain line 37 which fluidically connects the resin container 26, i.e. the water-softening agent container 26, to the washing tub 3 and is structured for selectively draining the brine or fresh water out of the resin container 26 and channelling said brine or fresh water directly into the washing tub 3.

As an alternative, the first water drain line 37 is structured for channeling the brine or fresh water stored into the resin container 26 preferably into the drain sump (not shown) that extends downwards from the bottom of the washing tub 3; or into the water filtering assembly (not shown) that is interposed between the drain sump of washing tub 3 and the suction of the water circulating pump (not shown) and/or of the water exhaust pump (not shown) which, in the example shown, are both preferably located on the bottom of casing 2; or substantially directly into the water exhaust pump (not shown) which drains the waste water or washing liquor outside of the laundry washing machine 1; or in any case into the waste-water drain line that channels the waste water or washing liquor outside the laundry washing machine 1.

In the example shown, in particular, the first water drain line 37 preferably comprises a hosepipe 38 or the like which directly connects the bottom of the resin container 26 to the washing tub 3, or to the drain sump (not shown), or to the water filtering assembly (not shown), or to the water exhaust pump (not shown); and an electrically-controlled on-off valve 39 which is located along the hosepipe 38 for controlling the outflow of the brine or fresh water from the resin container 26.

Lastly the internal water softening device 11 is preferably also provided with water-hardness sensor means (not shown) structured for measuring the hardness degree of the fresh water coming out from the resin container 26, i.e. the water-softening agent container 26, directed towards the detergent dispensing assembly 9.

In the example shown, in particular, the water-hardness sensor means are able to communicate with an internal electronic central control unit (not shown) which controls all electrically-operated component parts of the laundry washing machine 1, and is housed inside the boxlike casing 2, preferably on the back of the control panel 12 located on front wall 2*a*.

Still with reference to FIG. 6, the fresh-water supply circuit 10 is preferably, though not necessarily, also provided with a second water drain line 41 which is structured for selectively rerouting the brine or fresh water flowing towards the detergent dispensing assembly 9 either into the washing tub 3, or into the drain sump that extends downwards from the bottom of washing tub 3, or into a water filtering assembly that is interposed between the drain sump of washing tub 3 and the suction of a water circulating pump and of a water exhaust pump of the laundry washing machine 1, or into the water exhaust pump, so as to bypass at least the detergent container 18, i.e. the detergent drawer 18, of the detergent dispensing assembly 9.

In the example shown, in particular, the second water drain line 41 connects the outlet of the internal water softening device 11, and more specifically the outlet of resin container 26, to the washing tub 3 or to the drain sump (not shown) or to the water filtering assembly (not shown) or to the water exhaust pump (not shown) or in any case into the waste-water drain line that channels the waste water or washing liquor outside the laundry washing machine 1, bypassing the detergent container 18, i.e. the detergent drawer 18, of the detergent dispensing assembly 9.

The second water drain line 41 preferably comprises a hosepipe 42 or the like which is connected to a specific additional water outlet of the electrically-controlled hydraulic distributor 22 or similar valve assembly of the detergent dispensing assembly 9, and ends directly into the washing tub 3, or into the drain sump, or into the water filtering assembly, or into the water exhaust pump; and the electrically-controlled hydraulic distributor 22 is structured to selectively direct/channel directly into hosepipe 42 the brine of softened fresh water arriving from resin container 26 via hosepipe 15, so as to channel the brine or fresh water arriving from resin container 26 directly into the washing tub 3 or into the drain sump (not shown) or into the water filtering assembly (not shown) or into the water exhaust pump (not shown).

In a less sophisticated embodiment, the second water drain line 41 of fresh-water supply circuit 10 may comprise, immediately upstream of the drawer flush circuit 20, an electrically-controlled three-way valve or similar hydraulic distributor, which has a first outlet connected to the inlet of the drawer flush circuit 20 of detergent dispensing assembly 9, i.e. to the hydraulic distributor 22, and a second outlet connected to hosepipe 42 of water drain line 41. This electrically-controlled three-way valve is structured for selectively and alternatively channeling the fresh water coming out of the resin container 26 either to hosepipe 42, or to the inlet of the drawer flush circuit 20 of detergent dispensing assembly 9, i.e. to the hydraulic distributor 22.

In this alternative embodiment, therefore, the second water drain line 41 bypasses the whole detergent dispensing assembly 9, and therefore the drawer flush circuit 20 of detergent dispensing assembly 9 may lack the hydraulic distributor 22.

Preferably, with reference to FIG. 6, the laundry washing machine 1 is finally provided with a second fresh-water supply circuit 44 which is structured for being connectable to the water mains independently from the fresh-water supply circuit 10, and for selectively channeling the fresh water from the water mains to the detergent dispensing assembly 9 and/or directly to the washing tub 3, bypassing the water softening device 11.

In other words, the second fresh-water supply circuit 44 connects the water mains directly to the inlet of the drawer flush circuit 20 of detergent dispensing assembly 9 bypassing the water softening device 11, and is structured so as to selectively channel to the inlet of the drawer flush circuit 20 a second flow of non-softened fresh water of the water mains.

This second fresh-water supply circuit 44 therefore is able to channel the fresh water of the water mains directly towards the inlet of drawer flush circuit 20 independently from the fresh-water supply circuit 10.

Furthermore, if the second water drain line 41 is present, the second fresh-water supply circuit 44 is preferably also able to channel the non-softened fresh water of the water mains directly to the washing tub 3 via the water drain line 41 bypassing all detergent compartments 18*a* of the detergent drawer 18.

In other words, the fresh-water supply circuit 44 is able to channel the fresh water of the water mains directly towards the electrically-controlled hydraulic distributor 22 of detergent dispensing assembly 9, bypassing the water softening device 11. The electrically-controlled hydraulic distributor 22 then channels this non-softened fresh water selectively and alternatively towards the water drain line 41, or towards any one of the various detergent compartments 18*a* of the detergent drawer 18 according the washing cycle selected by the user.

With reference to FIG. 6, likewise the fresh-water supply circuit 10, the second fresh-water supply circuit 44 preferably comprises:

- a second electrically-controlled on-off valve 45 which is fluidically interposed between the water mains and the inlet of the hydraulic distributor 22, i.e. the inlet of the drawer flush circuit 20 of detergent dispensing assembly 9, and is able to control/regulate the flow of fresh water from the water mains towards the inlet of the hydraulic distributor 22, i.e. towards the inlet of the drawer flush circuit 20; and preferably also
- a hosepipe or the like 46 connecting the on-off valve 45 directly to the inlet of the electrically-controlled hydraulic distributor 22, i.e. to the inlet of the drawer flush circuit 20 of detergent dispensing assembly 9, bypassing the resin container 26.

Furthermore the second fresh-water supply circuit 44 preferably also comprises a second one-way valve 47 which is located downstream of the on-off valve 45, and is structured to allow the fresh water to only flow along the hosepipe 46, from the water mains to the inlet of the hydraulic distributor 22, i.e. to the inlet of the drawer flush circuit 20 of detergent dispensing assembly 9, and not vice versa.

The appliance control panel 12, in turn, is preferably, though not necessarily, structured so as to allow the user to manually select a desired washing cycle that uses softened water.

General operation of home laundry washing machine 1 is clearly inferable from the above description. When the on-off valve 13 is opened the fresh water flows from the water mains to the resin container 26 of the internal water softening device 11, wherein the ion-exchange resins reduce the hardness degree of the fresh water directed to the detergent dispensing assembly 9. The water-hardness sensor means monitor the hardness degree of the fresh water directed to the detergent dispensing assembly 9.

After having crossed the resin container 26, the softened fresh water of the water mains reaches the detergent dispensing assembly 9 and enters into the electrically-controlled hydraulic distributor 22 of drawer flush circuit 20. According to stage of the washing cycle, the hydraulic distributor 22 then channels said softened fresh water to one or more of the shower-making portions/sections 23*a* of the sprinkler head 23 for flushing the detergent, softener or other washing agent out of the corresponding detergent compartment 18*a* of the detergent drawer 18 and sweeping away said detergent, softener or other washing agent down into the washing tub 3 via the connecting duct connecting the bottom of drawer housing 19 to the inside of washing tub 3.

When it is determined that the ion-exchange resins inside the resin container 26 are no more able to reduce the hardness degree of the fresh water directed to the washing tub 3 via the detergent dispensing assembly 9, the electronic central control unit (not shown) of laundry washing machine 1 performs, preferably immediately before the starting of the rinsing phase of the washing cycle, a regeneration process of the ion-exchange resins stored inside the resin container 26.

The regeneration process may also take place during the washing phase of the washing cycle, or can take place even when no washing cycle at all is running, preferably on specific request of the user.

At beginning of the regeneration process, the central control unit of laundry washing machine 1 firstly opens the on-off valve 34 of the water supply circuit 28 for enough time to channel/pour into the regeneration-agent reservoir 27 an amount of fresh water sufficient to form, on the bottom of drawer housing 32 (i.e. into the regeneration-agent reservoir 27), the whole amount of brine necessary for the resin regeneration process to take place.

During the preparation of the brine inside the regeneration-agent reservoir 27, the central control unit of laundry washing machine 1 can keep the on-off valve 13 of fresh-water supply circuit 10 either in the closed position or in the opened position according to current phase of the washing cycle.

When the whole amount of brine is formed into the regeneration-agent reservoir 27, the central control unit of laundry washing machine 1 closes the on-off valve 13 of the fresh-water supply circuit 10 to stop the flow of fresh water across the resin container 26, and preferably arranges the hydraulic distributor 22 of detergent dispensing assembly 9 so as to channel the fresh water arriving from the resin container 26 directly into the second water drain line 41.

Afterwards, the central control unit of laundry washing machine 1 activates the brine-circulating pump 29 to transfer/move the whole amount of brine at a time from the bottom of drawer housing 32, i.e. from the regeneration-agent reservoir 27, to the resin container 26, i.e. to the water-softening agent container 26. Since the resin container 26 is completely filled with the fresh water of the water mains, the brine entering into the resin container 26 pushes out of the resin container 26 the fresh water previously stored therein. This fresh water flows along hosepipe 15 of fresh-water supply circuit 10 towards the hydraulic distributor 22 which, in turn, directs/channels said fresh water directly into the second water drain line 41.

When resin container 26 is completely filled with a sufficient amount of brine, the central control unit of laundry washing machine 1 deactivates the brine-circulating pump 29 to watertight sealing the resin container 26 from the regeneration-agent reservoir 27, and to restrain the brine inside the resin container 26 for a predetermined time interval generally sufficient to allow the brine to remove from the ion-exchange resins the calcium and magnesium ions previously combined/fixed to said resins.

When the regeneration process of the ion-exchange resins is completed, the central control unit of laundry washing machine 1 opens again the on-off valve 13 of fresh-water supply circuit 10, so that the pressurized fresh water of the water mains pushes the brine out of the resin container 26 and into the hosepipe 15 which channels the brine towards the hydraulic distributor 22 which, in turn, directs/channels said fresh water directly into the second water drain line 41.

Alternatively, the central control unit of laundry washing machine 1 may open the on-off valve 39 of the first water drain line 37 so to drain the brine out of the resin container 26 through the water drain line 37.

The brine stored in the resin container 26 therefore flows directly into the washing tub 3 or into the drain sump or into the water filtering assembly, or into the water exhaust pump, via the water drain line 37 and/or via the water drain line 41.

Finally, preferably after having closed again the on-off valves 13 and 39, the central control unit of the laundry washing machine 1 activates the water exhaust pump so to discharge the brine out of the laundry washing machine 1 preferably together with the washing or rinsing water already stored on the bottom of the washing tub 3, and continues the washing cycle.

The second fresh-water supply circuit 44, in turn, can channel the fresh water of the water mains towards the inlet of drawer flush circuit 20 bypassing the water softening device 11, so to channel the non-softened fresh water of the water mains directly towards the inlet of hydraulic distributor 22. The electrically-controlled hydraulic distributor 22 therefore can channel towards any one of the detergent compartments 18*a* of detergent drawer 18, or towards the second water drain line 41 if connected to the hydraulic distributor 22, either softened or non-softened (i.e. normal) fresh water of the water mains.

If the fresh-water supply circuit 10 has a three-way valve upstream of the inlet of the drawer flush circuit 20 of detergent dispensing assembly 9, i.e. upstream of the hydraulic distributor 22, and the second water drain line 41 branches off from said three-way valve, the non-softened fresh water of the water mains may be directed/channeled directly into the second water drain line 41 without reaching the hydraulic distributor 22 of detergent dispensing assembly 9.

The laundry washing machine 1 is therefore able to use, during each stage of the washing cycle, either softened or non-softened fresh water of the water mains or a mixture of them. The second fresh-water supply circuit 41, in fact, can channel non-softened fresh water to the inlet of the drawer flush circuit 20 of detergent dispensing assembly 9 independently from the fresh-water supply circuit 10, thus also at the same time of the fresh-water supply circuit 10.

In a less sophisticated embodiment, however, the electronic central control unit of the laundry washing machine 1 may be programmed to regenerate the ion-exchange resins stored in the resin container 26 after a given number of washing cycles. This number of washing cycles may be decided by the user on the basis of an alleged hardness degree of the fresh water coming out from the water mains.

In this less sophisticated embodiment the water-hardness sensor means monitor are unnecessary.

The advantages resulting from the arrangement of the detergent dispensing assembly 9 and of the water softening device 11 on opposite sides of vertical center-plane M of boxlike casing 2, preferably substantially in specular position on the upper corners of the front wall 2*a* of casing 2, are remarkable. Firstly, moving the water softening device 11 on the other side of the vertical center-plane M of boxlike casing 2 allows significantly increasing the inner volume of the regeneration-agent reservoir 27, thus significantly improving its salt-storing capacity and consequently the time interval between two consecutive refillings of salt.

Furthermore the brine-circulating pump 29 allows arranging the resin container 26, i.e. the water-softening agent container 26, to be spaced far away from the regeneration-agent reservoir 27, in any place inside the boxlike casing 2, even above the regeneration-agent reservoir 27 or horizontally aligned at the back of the regeneration-agent reservoir 27, thus allowing significantly increasing also to the inner volume of the resin container 26 with all advantages concerned.

The second fresh-water supply circuit 44 bypassing the internal water softening device 11, instead, allows improving the working flexibility of the laundry washing machine 1. During pre-wash or rinse phases of the washing cycle, when detergent agents are usually not required, the laundry washing machine 1 can use normal fresh water, thus lengthening the time between the regenerations of the ion-exchange resins.

Furthermore the appliance control panel 12 on front wall 2*a* may be structured so as to allow the user to manually select washing cycles that uses softened fresh water.

Changes may be made to the front-loading laundry washing machine 1 as described above without, however, departing from the scope of the present invention.

For example, in first alternative non-shown embodiment the electrically-powered brine-circulating pump 29 may be replaced by an electrically-powered pump assembly comprising a conventional electrically-powered suction pump and an on-off valve which is arranged immediately upstream of the suction pump and is structured to watertight seal the suction/inlet of the electrically-powered suction pump when the latter is deactivated, and to put the suction/inlet of the electrically-powered suction pump in direct communication with the inside of the regeneration-agent reservoir 27 when the suction pump is activated.

Furthermore, in a second alternative non-shown embodiment the electrically-powered brine-circulating pump 29 may be replaced by an electrically-controlled on-off valve which is arranged/interposed between the water-softening agent container 26 and the regeneration-agent reservoir 27, and is structured to selectively and alternatively put the regeneration-agent reservoir 27 in direct communication with the water-softening agent container 26 for allowing the brine to flow by gravity from the regeneration-agent reservoir 27 to the water-softening agent container 26, or to completely watertight seal/isolate the regeneration-agent reservoir 27 from the water-softening agent container 26.

The electrically-controlled on-off valve 39 of water drain line 37, instead, may be replaced by an electrically-powered water drain pump which directly communicates with the resin container 26 and is structured for preventing, when deactivated, any outflow of the brine or fresh water from the resin container 26, and for sucking out of the resin container 26, when activated, the water stored into the resin container 26 and pumping said water into the washing tub 3 via hosepipe 38.

Obviously the electrically-powered water drain pump may be replaced by a electrically-powered water drain pump assembly which comprises a conventional electrically-powered suction pump and an on-off valve which is arranged immediately upstream of the suction pump and is structured to watertight seal the suction/inlet of the electrically-powered suction pump when the latter is deactivated, and to put the suction/inlet of the electrically-powered suction pump in direct communication with the inside of the resin container 26 when the suction pump is activated.

Figure 7:
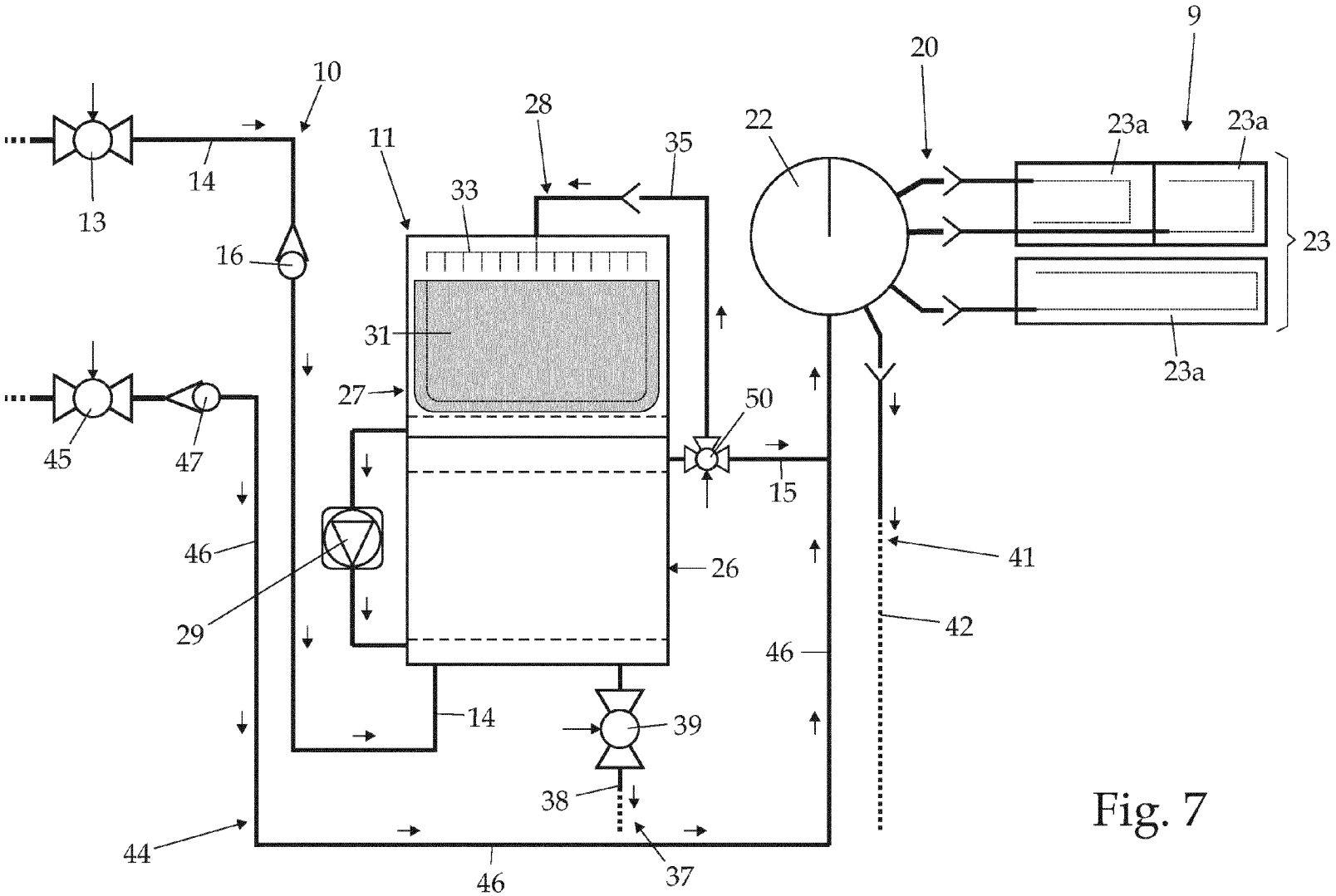
FIG. 7 is a schematic view of a first alternative embodiment of the internal water softening device of the FIG. 1 laundry washing machine.

With reference to FIG. 7, rather than being directly connected to the water mains, in an alternative embodiment the water supply circuit 28 of water softening device 11 preferably branches off from the fresh-water supply circuit 10 downstream of resin container 26, so as to selectively channel into the regeneration-agent reservoir 27 the softened fresh water coming out of resin container 26.

In this embodiment, the water supply circuit 28 lacks the on-off valve 34 and instead comprises an electrically-controlled three-way valve 50 which is arranged along the fresh-water supply circuit 10, downstream of resin container 26, i.e. along the hosepipe 15 connecting the outlet of resin container 26 to the inlet of the drawer flush circuit 20 of detergent dispensing assembly 9.

The hosepipe 35 or the like of water supply circuit 28 is now connected to the three-way valve 50, and the electrically-controlled three-way valve 50 is structured for selectively and alternatively channeling the fresh water coming out of the resin container 26 either to the sprinkler head 33 for producing the brine or, according to the arrangement of the water softening device 11, to the inlet of the drawer flush circuit 20 of detergent dispensing assembly 9 or directly to the washing tub 3 via the second water drain line 41.

In this embodiment, at the beginning of the regeneration process, the central control unit of laundry washing machine 1 sets the three-way valve 50 so as to put the outlet of resin container 26 in direct communication with the sprinkler head 33, and afterwards it opens the on-off valve 13 for enough time to channel, on the bottom of drawer housing 32 (i.e. into the regeneration-agent reservoir 27), the whole amount of fresh water necessary to form an amount of brine sufficient for the resin regeneration process to take place. This fresh water obviously flows across the resin container 26 before reaching the regeneration-agent reservoir 27.

Then, after having closed the on-off valve 13, the central control unit of laundry washing machine 1 sets the three-way valve 50 so as to put again the outlet of resin container 26 in direct communication with the detergent dispensing assembly 9, and afterwards activates the brine-circulating pump 29 to transfer/move the whole amount of brine at a time from the regeneration-agent reservoir 27, i.e. from the bottom of drawer housing 32, to the resin container 26.

As an alternative, at the beginning of the regeneration process, the central control unit of laundry washing machine 1 sets the three-way valve 50 so as to put the outlet of resin container 26 in direct communication with the sprinkler head 33, and afterwards it opens the on-off valve 13 for a short time, so as to spill/pour a small amount of fresh water into the regeneration-agent reservoir 27 to form some brine.

When said small amount of fresh water has reached the regeneration-agent reservoir 27, the central control unit of laundry washing machine 1 closes the on-off valve 13 of fresh-water supply circuit 10, and activates the brine-circulating pump 29 so as to transfer/move the brine (i.e. the salt water) from the regeneration-agent reservoir 27, i.e. from the bottom of drawer housing 32, to the resin container 26.

Then the central control unit of laundry washing machine 1 maintains the brine-circulating pump 29 activated for a given time interval so as to continue circulating the fresh water in closed loop along the resin container 26 and the water supply circuit 28, for dissolving much more salt and thus increase the salt degree of the brine. The brine entering into the resin container 26, in fact, pushes out of the resin container 26 the fresh water or brine previously stored therein. This fresh water or brine flow towards the three-way valve 50 which directs/channels the same fresh water or brine into the regeneration-agent reservoir 27 via the water supply circuit 28 to form other brine.

In other words, in this case the brine-circulating pump 29 circulates the fresh water in closed loop along the resin container 26, the water supply circuit 28 and the regeneration-agent reservoir 27.

Figure 8:
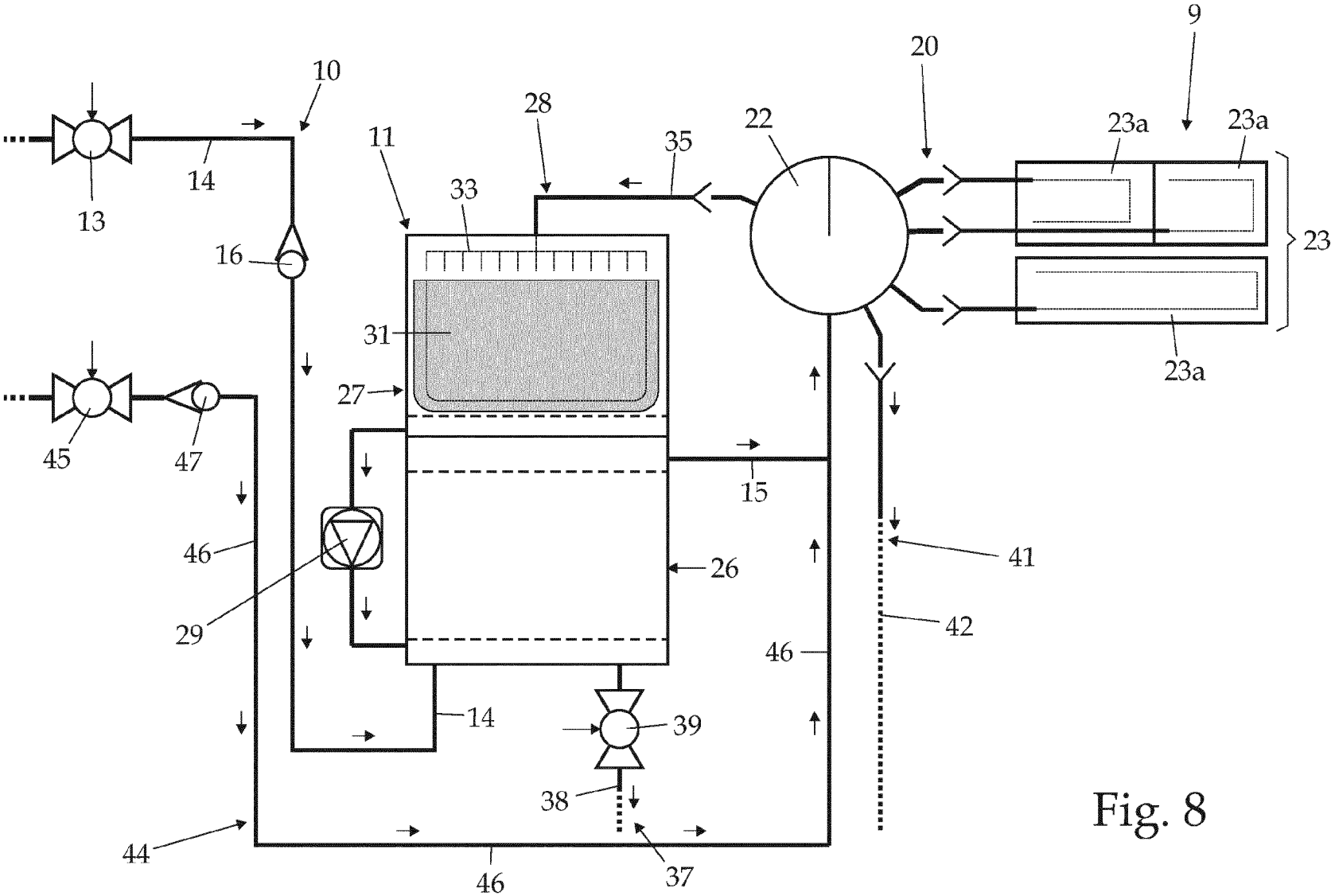
FIG. 8 is a schematic view of a second alternative embodiment of the internal water softening device of the FIG. 1 laundry washing machine.

With reference to FIG. 8, in a second more sophisticated embodiment, rather than being directly connected to the water mains, the water supply circuit 28 of water softening device 11 preferably branches off from the electrically-controlled hydraulic distributor or similar valve assembly 22 of drawer flush circuit 20 of detergent dispensing assembly 9, so as to selectively channel into the regeneration-agent reservoir 27 the softened fresh water entering into the drawer flush circuit 20 of detergent dispensing assembly 9.

In other words, the water supply circuit 28 lacks the on-off valve 34 and the hosepipe 35 of water supply circuit 28 is now connected to a specific additional water outlet of the electrically-controlled hydraulic distributor 22 of detergent dispensing assembly 9, and the electrically-controlled hydraulic distributor 22 is structured to selectively direct/channel into hosepipe 35 the softened fresh water or brine arriving from resin container 26 via hosepipe 15.

In this embodiment, at the beginning of the regeneration process, the central control unit of laundry washing machine 1 firstly arranges the hydraulic distributor 22 so as to channel the fresh water arriving into hydraulic distributor 22 towards the water supply circuit 28, and afterwards it opens the on-off valve 13 for enough time to channel, on the bottom of drawer housing 32 (i.e. into the regeneration-agent reservoir 27), the whole amount of fresh water necessary to form an amount of brine sufficient for the resin regeneration process to take place. This fresh water flows across the resin container 26, and the hydraulic distributor 22 of detergent dispensing assembly 9 before reaching the regeneration-agent reservoir 27.

Then, after having closed the on-off valve 13, the central control unit of laundry washing machine 1 arranges the hydraulic distributor 22 so as to put the outlet of resin container 26 in communication with the second water drain line 41, and afterwards activates the brine-circulating pump 29 to transfer/move the whole amount of brine at a time from the regeneration-agent reservoir 27, i.e. from the bottom of drawer housing 32, to the resin container 26.

As an alternative, at the beginning of the regeneration process, the central control unit of laundry washing machine 1 firstly arranges the hydraulic distributor 22 so as to channel the fresh water arriving into hydraulic distributor 22 towards the water supply circuit 28, and afterwards it opens the on-off valve 13 for a short time, so as to spill/pour a small amount of fresh water into the regeneration-agent reservoir 27 to form some brine.

When said small amount of fresh water has reached the regeneration-agent reservoir 27, the central control unit of laundry washing machine 1 closes the on-off valve 13 of fresh-water supply circuit 10, and activates the brine-circulating pump 29 so as to transfer/move the brine (i.e. the salt water) from the regeneration-agent reservoir 27, i.e. from the bottom of drawer housing 32, to the resin container 26.

Then the central control unit of laundry washing machine 1 maintains the brine-circulating pump 29 activated for a given time interval so as to continue circulating the fresh water in closed loop along the resin container 26, the hydraulic distributor 22 and the water supply circuit 28, for dissolving much more salt and thus increase the salt degree of the brine. The brine entering into the resin container 26, in fact, pushes out of the resin container 26 the fresh water or brine previously stored therein. This fresh water or brine flows towards the hydraulic distributor 22 which directs/channels the same fresh water or brine into the regeneration-agent reservoir 27 via the water supply circuit 28 to form other brine.

In other words, in this case the brine-circulating pump 29 circulates the fresh water in closed loop along the resin container 26, the hydraulic distributor 22 of detergent dispensing assembly 9, the water supply circuit 28 and the regeneration-agent reservoir 27.

When the water-softening agent container 26 is completely filled with a sufficient amount of brine, the central control unit of laundry washing machine 1 deactivates the brine-circulating pump 29 to watertight seal the resin container 26 from the regeneration-agent reservoir 27, and arranges the hydraulic distributor 22 so as to put the outlet of resin container 26 in communication with the second water drain line 41.

Furthermore, in a first non-shown less sophisticated embodiment the brine-circulating pump 29 may be replaced by an electrically-controlled on-off valve which is structured to selectively and alternatively put the regeneration-agent reservoir 27 in direct communication with the water-softening agent container 26 for allowing the brine to flow by gravity from the regeneration-agent reservoir 27 to the water-softening agent container 26, or to completely watertight seal/isolate the regeneration-agent reservoir 27 from the water-softening agent container 26. In this less sophisticated embodiment, the water-softening agent container 26 has to be arranged beneath the regeneration-agent reservoir 27.

As an alternative, in a second non-shown less sophisticated embodiment the brine-circulating pump 29 may be replaced by a passive one-way valve which is structured for allowing the brine to flow by gravity from the regeneration-agent reservoir 27 to the water-softening agent container 26, and not vice versa.

Figure 9:
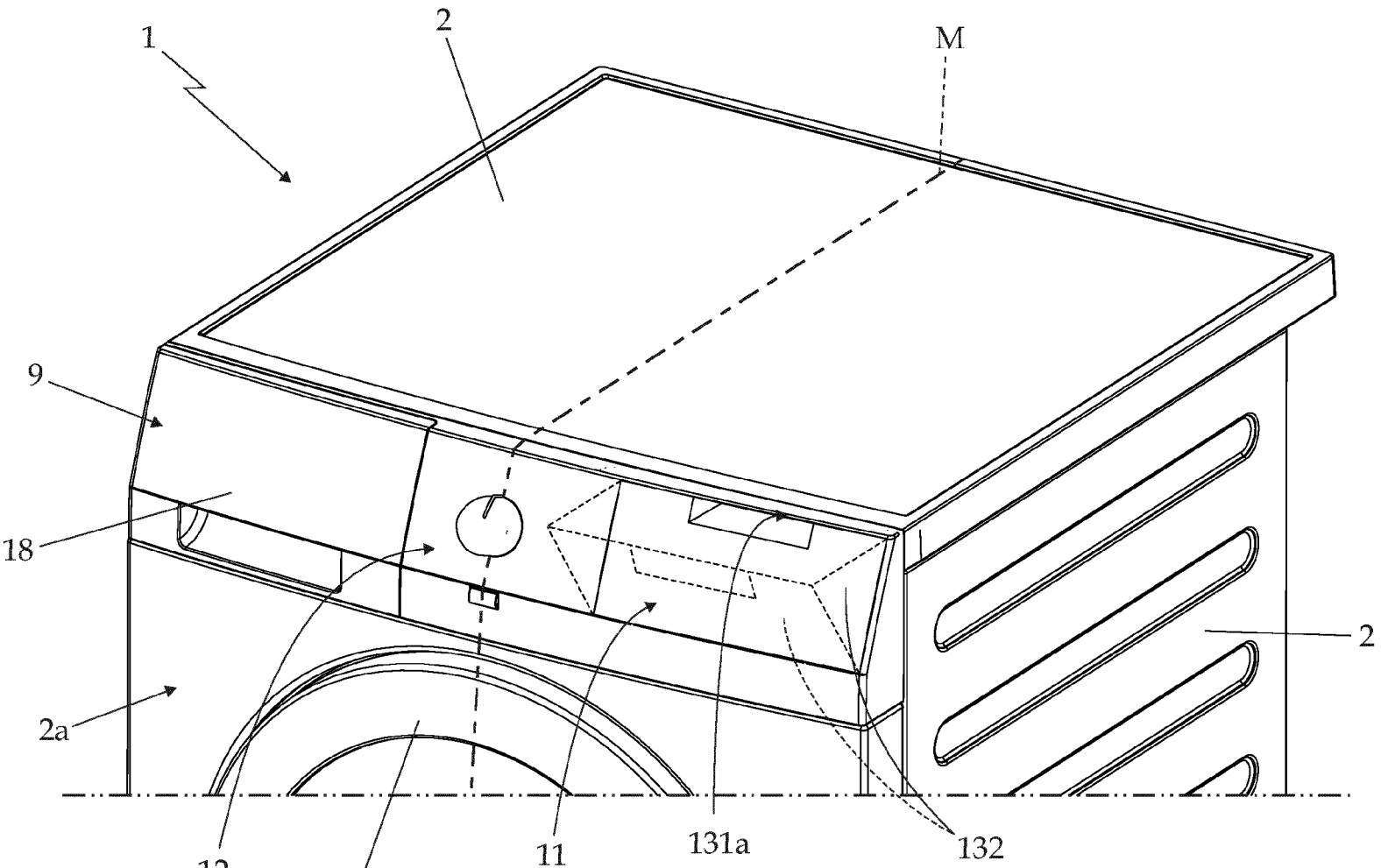
FIG. 9 is a perspective view of a second embodiment of the FIG. 1 laundry washing machine.

Finally, with reference to FIG. 9, in a further alternative embodiment the regeneration-agent reservoir 27 comprises, in place of salt drawer 31 and drawer housing 32, a substantially box-shaped, regeneration-agent container 131 which is dimensioned to store a relevant amount of salt or other regeneration agent, is permanently completely recessed into the boxlike casing 2, adjacent to the front wall 2*a*, and communicates with the outside of casing 2 via a corresponding front entrance or opening 131*a* which is realized on front wall 2*a* of casing 2 preferably so as to be locally substantially horizontally aligned to the entrance or front opening 19*a* of the drawer housing 19 of the detergent dispensing.

The regeneration-agent reservoir 27 furthermore comprises a manually-operated shutter door 132 which is preferably hinged to the front wall 2*a* of casing 2 to rotate about a substantially horizontally-oriented reference axis, to and from a closing position in which the peripheral border of the shutter door 132 rests on front wall 2*a* to close the front entrance or opening 131*a* of the regeneration-agent container 131. Preferably this shutter door 132 is furthermore shaped/structured so as to form, when arranged in the opened position, a slide or downwards-converging hopper suitably dimensioned to easily channel the salt or other regeneration agent into the regeneration-agent container 131.

The invention claimed is:

1. A laundry washing machine comprising:

an outer casing;

inside said outer casing, a washing tub arranged inside the casing, the washing tub having an opening directly facing a laundry loading/unloading opening which is realized in a front wall of the outer casing substantially astride of a vertical center-plane of the outer casing;

a rotatable drum arranged in an axially rotating manner inside the washing tub and structured for receiving laundry to be washed;

a detergent dispensing assembly configured for supplying detergent into the washing tub;

a main fresh-water supply circuit configured for selectively channeling a flow of fresh water from water mains towards the detergent dispensing assembly and/or the washing tub; and a water softening device arranged along the main fresh-water supply circuit so as to be crossed by the flow of fresh water flowing from the water mains to the detergent dispensing assembly and/or the washing tub, the water softening device being configured for reducing a hardness degree of fresh water supplied to the washing tub, wherein the detergent dispensing assembly and the water softening device are each provided with respective loading inlets exposable to an outside surface on the front wall of casing, and wherein the loading inlets are located on the front wall of the casing, on opposite sides of the vertical center-plane of the casing.

2. The laundry washing machine according to claim 1, wherein the loading inlet of the detergent dispensing assembly and the loading inlet of the water softening device are both arranged on the front wall of the casing, above the laundry loading/unloading opening.

3. The laundry washing machine according to claim 1, wherein the loading inlet of the detergent dispensing assembly and the loading inlet of the water softening device are substantially horizontally aligned to one another, on opposite sides of the vertical center-plane of the casing.

4. The laundry washing machine according to claim 1, wherein the loading inlet of the detergent dispensing assembly and the loading inlet of the water softening device are arranged on the front wall of the casing substantially in specular position to one another, on opposite sides of the vertical center-plane of the casing.

5. The laundry washing machine according to claims 1, wherein the loading inlet of the detergent dispensing assembly and the loading inlet of the water softening device are arranged on the front wall of the casing, each located close to, or substantially on, a respective upper corner of the front wall of the casing.

6. The laundry washing machine according to claim 1, further comprising an appliance control panel located on the front wall of the casing, between the loading inlet of the detergent dispensing assembly and the loading inlet of the water softening device.

7. The laundry washing machine according to claim 6, wherein the appliance control panel is arranged on the front wall of the casing astride of the vertical center-plane of the casing.

8. The laundry washing machine according to claim 6, wherein the appliance control panel is configured for allowing a selection of a washing cycle using softened water.

9. The laundry washing machine according to claim 1, wherein the detergent dispensing assembly comprises a detergent container which is fillable with a given quantity of detergent, softener and/or other washing agent, and which is housed inside the casing into a corresponding external housing, and wherein the front wall of the casing being is provided with a corresponding pass-through opening through which the detergent container is accessible.

10. The laundry washing machine according to claim 9, wherein the detergent dispensing assembly further comprises a detergent drawer which is fillable with a given quantity of detergent, softener and/or other washing agent, and which is configured to be inserted in a manually extractable manner into a corresponding recessed drawer housing located on the front wall of the casing and extending inside the casing, wherein the recessed drawer housing communicates with the outside surface of the front wall of the casing via a front opening on the front wall of said casing.

11. The laundry washing machine according to claim 9, wherein the detergent dispensing assembly further comprises a detergent flush circuit which is connected to the main fresh-water supply circuit and which is configured for selectively spilling/pouring a given amount of fresh water arriving from the water mains so as to flush a given quantity of the detergent, softener or other washing agent down into the washing tub.

12. The laundry washing machine according to claim 1, wherein the water softening device comprises:

a water-softening agent container which is configured to be crossed by fresh water flowing along the main fresh-water supply circuit and which is configured to be filled with a water softening agent able to reduce a hardness degree of the fresh water flowing through the water-softening agent container; and a regeneration-agent reservoir fluidically connected to the water-softening agent container, and configured to receive a salt or other regeneration agent for performing a regeneration of a water softening function of water softening agents stored in the water-softening agent container, the regeneration-agent reservoir being provided with a loading inlet formed the inlet of the water softening device.

13. The laundry washing machine according to claim 12, wherein the regeneration-agent reservoir comprises a regeneration-agent container which is manually fillable with a given quantity of regeneration agents and which is housed inside the casing into a corresponding external housing, and wherein the front wall of the casing is provided with a corresponding pass-through opening through which the regeneration-agent container is accessible.

14. The laundry washing machine according to claim 13, wherein the regeneration-agent reservoir further comprises a salt drawer which is dimensioned for being manually fillable with a given amount of salt grains or other water-softening chemical agent, and which is inserted in a manually extractable manner into a corresponding recessed, drawer housing which extends inside the casing and communicates with the outside surface of the front wall of the casing via a front opening on the front wall of said casing.

15. The laundry washing machine according to claim 12, wherein the water softening device further comprises a water supply circuit configured for channeling, on command, a given amount of fresh water into the regeneration-agent reservoir to at least partly dissolve the salt or other regeneration agents stored therein and form a given amount of brine.

16. The laundry washing machine according to claim 15, wherein the water supply circuit of the water softening device is configured for spilling/pouring a shower of water droplets by gravity directly into the regeneration-agent reservoir.

17. The laundry washing machine according to claim 15, wherein the water supply circuit of the water softening device branches off from the main fresh-water supply circuit.

18. The laundry washing machine according to claim 15, wherein the water supply circuit of the water softening device is configured to be connectable to the water mains independently from the main fresh-water supply circuit.

* * * * *